US007878686B2

(12) United States Patent
Suehiro et al.

(10) Patent No.: US 7,878,686 B2
(45) Date of Patent: Feb. 1, 2011

(54) LIGHT EMITTING DEVICE HAVING A PLURALITY OF STACKED RADIATING PLATE MEMBERS

(75) Inventors: Yoshinobu Suehiro, Aichi-ken (JP); Koji Tasumi, Aichi-ken (JP)

(73) Assignee: Toyoda Gosei Co., Ltd., Nishikasugai-gun, Aichi-ken (JP)

( * ) Notice: Subject to any disclaimer, the term of this patent is extended or adjusted under 35 U.S.C. 154(b) by 164 days.

(21) Appl. No.: 11/589,296

(22) Filed: Oct. 30, 2006

(65) Prior Publication Data

US 2007/0097692 A1 May 3, 2007

(30) Foreign Application Priority Data

Oct. 31, 2005 (JP) ..... 2005-316694
Oct. 16, 2006 (JP) ..... 2006-281714

(51) Int. Cl.
*F21V 29/00* (2006.01)

(52) U.S. Cl. ..... 362/294; 362/373; 362/800

(58) Field of Classification Search ..... 362/294, 362/373, 547, 345, 800, 580, 218, 264; 257/98–99, 257/712, 714; 174/16.3, 548; 165/80.3, 165/10; 361/697, 703–704, 709
See application file for complete search history.

(56) References Cited

U.S. PATENT DOCUMENTS 6,199,627 B1 * 3/2001 Wang ..... 165/185
6,289,975 B2 * 9/2001 Kuo ..... 165/80.3
6,411,510 B2 * 6/2002 Sasa et al. ..... 361/697
6,782,941 B2 * 8/2004 Lee ..... 165/80.3
7,218,041 B2 * 5/2007 Isoda ..... 313/11
7,443,678 B2 * 10/2008 Han et al. ..... 361/704
2002/0043360 A1 * 4/2002 Lee ..... 165/80.3
2005/0068776 A1 * 3/2005 Ge ..... 362/296
2005/0274959 A1 * 12/2005 Kim et al. ..... 257/79
2006/0049335 A1 * 3/2006 Suehiro et al. ..... 250/214.1
2006/0061970 A1 * 3/2006 Lee ..... 361/709
2006/0164836 A1 * 7/2006 Suehiro et al. ..... 362/294
2006/0181894 A1 * 8/2006 Chinniah et al. ..... 362/547
2008/0149305 A1 * 6/2008 Chen ..... 165/80.3

FOREIGN PATENT DOCUMENTS

WO WO 2005/043637 A1 5/2005

* cited by examiner

*Primary Examiner*—Alan Cariaso
(74) *Attorney, Agent, or Firm*—McGinn IP Law Group, PLLC

(57) ABSTRACT

A light emitting device has a light source having a light emitting element; and a radiator having plural plate members formed of a thermally-conductive material. The plural plate members are stacked on each other while allowing formation of a space between each other at an end portion thereof. The light source is mounted on a side surface of the plural stacked plate members.

24 Claims, 35 Drawing Sheets

LIGHT EMITTING DEVICE HAVING A PLURALITY OF STACKED RADIATING PLATE MEMBERS

The present application is based on Japanese patent application Nos. 2005-316694 and 2006-281714, the entire contents of which are incorporated herein by reference.

BACKGROUND OF THE INVENTION

1. Field of the Invention

This invention relates to a light emitting device comprising a light emitting diode (hereinafter referred to as "LED") element as a light source and, in particular, to a light emitting device that has a high radiation performance for heat generated from the LED element and is excellent in productivity.

2. Description of the Related Art

LED is suitable for an application of a light source in view of an environmental protection and an electrical power saving. Therefore, LED is expected to be applied to a broad application such as a small sized electronics device, a lighting device and a lamp fitting as a white light source, as well as a substituting light source for a fluorescent lamp. According to this, recently, light emitting devices using LEDs of various types such as LED of a high output type and LED of a large light amount type have been proposed, but a problem of the heat accompanying the emission have become evident. Therefore, it becomes an important issue that how to ensure a high radiation performance in order to realize a light emitting device using LED of a high output type.

As an example of a LED light emitting device improved in a radiation performance, a light emitting device shown in a patent document of PCT International Publication Pamphlet No. 2005/043637 (7 page, FIG. 1, FIG. 9 FIG. 10 and FIG. 12) is known. The light emitting device comprises a radiation plate which comprises plate members composed of a high thermally-conductive material, mounts a light source part comprising a light emitting element as a light source, and is formed so as to comprise a radiation width disposed in a side of a back surface of the light source part.

The light emitting device shown in the patent document comprises a mounting part of the LED element in an edge surface of the radiation plate, and to slits formed at one of the radiation plates the other radiation plate is inserted so that two radiation plates are assembled to a cross-shaped plates and a radiation width is disposed in a side of a back surface of the LED element. Also, the radiation plate can be formed by an extrusion process.

According to the light emitting device shown in the patent document, a radiator is formed by assembling the radiation plates comprising a radiation width disposed in a direction parallel to a light axis of the LED element, so that a high heat conductivity can be realized without interfering with an emission property of a light emitted from the LED element and an atmosphere radiation performance can be enhanced.

However, in the light emitting device shown in the patent document there are the following problems.

(1) It is necessary to conduct a positioning for inserting and fixing of the radiation plates appropriately when the radiator is formed by assembling the radiation plates so that the assembling work becomes troublesome and then it becomes difficult to improve a productivity of the light emitting device.

(2) It is necessary to form the radiator so as to comprise a structural strength be capable of bearing with an extrusion process when the radiator is formed by the extrusion process so that it is limited to reduce a size of the light emitting device and a thickness of the radiation plates.

SUMMARY OF THE INVENTION

It is an object of the invention to provide a light emitting device that can be easy assembled and downsized while having a high radiation performance to meet the high output requirement.

(1) According to one embodiment of the invention, a light emitting device comprises:

a light source comprising a light emitting diode (LED) element; and a radiator comprising a plurality of plate members comprising a thermally-conductive material wherein the plurality of plate members are stacked on each other while allowing formation of a space between each other at an end portion thereof, and the light source is mounted on a side surface of the plurality of stacked plate members.

In the above invention (1), the following modifications and changes can be made.

(i) The light source comprises the light emitting diode (LED) element mounted on a submount.

(ii) The light source comprises: an inorganic substrate mounting the light emitting diode (LED) element thereon and comprising a same thermal expansion coefficient as the light emitting diode (LED) element; and an inorganic sealing material sealing the light emitting diode (LED) element and comprising a same thermal expansion coefficient as the light emitting diode (LED) element.

(iii) The radiator comprises the stacked plate members integrated by caulking.

(iv) The radiator comprises the stacked plate members comprising an edge part formed into a corrugated shape.

(v) The light source comprises a wavelength converter to convert a wavelength emitted from the light emitting diode (LED) element.

(vi) The light emitting device further comprises a casing part surrounding the stacked plate members of the radiator.

(2) According to another embodiment of the invention, a light emitting device comprises:

a light source comprising a light emitting diode (LED) element;

a radiator comprising a plurality of plate members comprising a thermally-conductive material, wherein the plurality of plate members are stacked to allow formation of a space between each other at an end portion thereof, and the light source is mounted on a side surface of the radiator; and a reflecting mirror part to reflect a light emitted from the light source in a direction along a surface of the plate members, and to lead the light to a back surface side of the light source.

In the above invention (2), the following modifications and changes can be made.

(vii) The reflecting mirror part comprises a paraboloid of revolution with the light source located nearly at a focus thereof while covering the light source.

(3) According to another embodiment of the invention, a light emitting device comprises:

a light source comprising a light emitting diode (LED) element; and a radiator comprising a plurality of thermally conductive plates, wherein the plurality of thermally conductive plates are bonded to each other while allowing at least a part thereof to be separated from each other.

In the above invention (3), the following modifications and changes can be made.

(viii) The radiator comprises a thermal conductivity of 100 W/m·K or more.

(ix) The plurality of thermally conductive plates are directly bonded to the light source.

(x) The light emitting device further comprising:

a thermally conductive member disposed between the light source and the plurality of thermally conductive plates to allow heat transmission from the light source to the plurality of thermally conductive plates.

(xi) The plurality of thermally conductive plates are folded at a part thereof.

(xii) The light source further comprises a substrate on which the LED element is mounted, an inorganic sealing material to seal the LED element, and the LED element and the inorganic sealing material comprise a thermal expansion coefficient of $10\times10^{-6}$/° C. or less.

(xiii) The light source further comprises: a plurality of the LED elements; a substrate on which the plurality of the LED elements are mounted; and a radiation pattern that is formed on an opposite surface to a mounting surface of the substrate, the LED elements being mounted on the mounting surface, and is bonded to the radiator.

(xiv) The radiation pattern is formed by metallizing.

(xv) The radiation pattern is mounted on the radiator through a material comprising Au and Sn.

(xvi) The substrate comprises a thickness that is smaller than an interval at which the plurality of the LED elements are disposed on the substrate.

(xvii) The light source comprises an area of not more than ten times a total area of the plurality of the LED elements when viewed from a main surface thereof.

(xviii) The light emitting device further comprising an optical system to which a light emitted from the light source is inputted.

<Advantages of the Invention>

According to the invention, a light emitting device can be easy assembled and downsized while having a high radiation performance to meet the high output requirement.

Particularly, in the above invention (1), the radiator can be easy assembled by using the plate members which is easy available and workable. Thus, the light emitting device can be downsized without any limitation in its processing.

Further, in the above invention (2), in addition to the advantage of the invention (1), the reflecting mirror part reflects a light emitted from the light source and leads the light along the surface of the radiation plates as a component of the radiator through spaces formed between the radiation plates so that the light can be led to a side of a back surface of the light source while suppressing the light loss.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First Embodiment

Composition of Light Emitting Device

Figure 1:
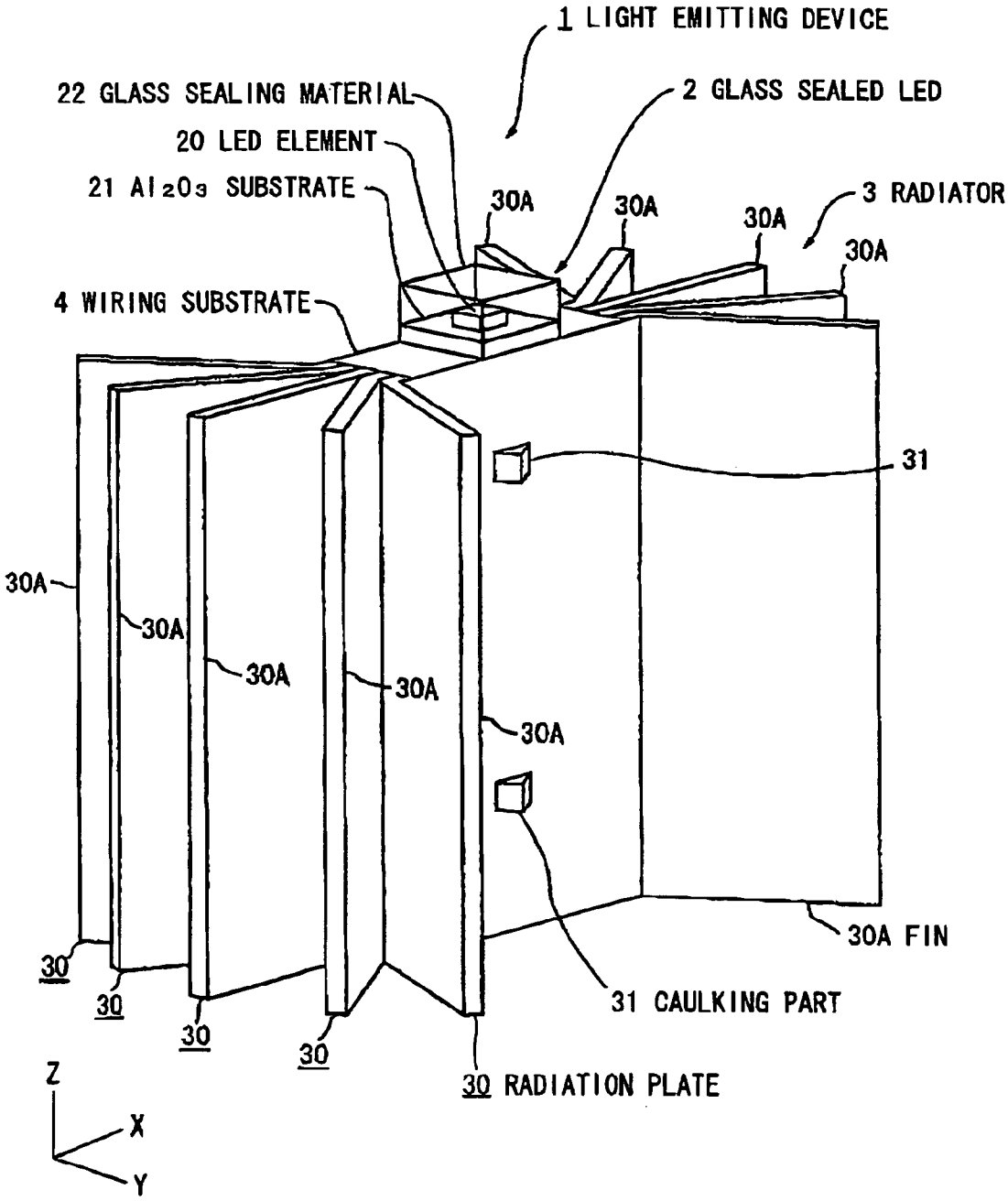
FIG. 1 is a perspective view schematically showing a light emitting device in a first preferred embodiment according to the invention.

FIG. 1 is a perspective view schematically showing a light emitting device in the first preferred embodiment according to the invention. In explaining the following preferred embodiment, hereinafter, a width direction of the light emitting device 1 is defined as X, a length direction is defined as Y, and a height direction is defined as Z.

As shown in FIG. 1, the light emitting device 1 comprises a glass sealed LED 2 formed by sealing a LED element 20 with a glass, and a radiator 3 comprising plate members 30 composed of a thermally-conductive material and integrated at a caulking part 31. The glass sealed LED 2 is fixed on a top surface of the radiator 3 and is connected to a wiring layer 41 of a wiring substrate 4 disposed on the top surface of the radiator 3.

Figure 2:
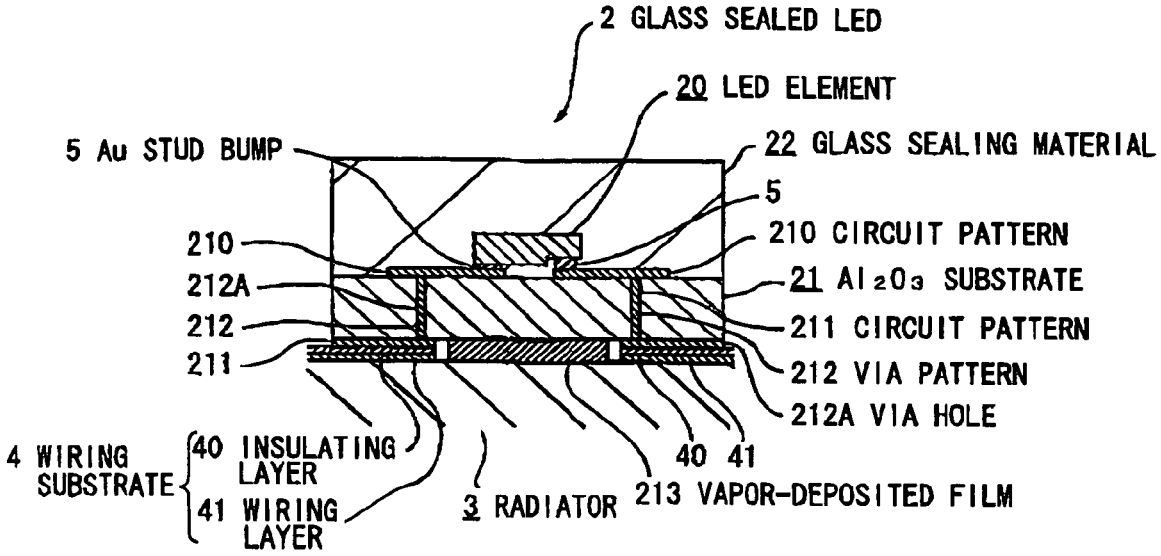
FIG. 2 is a substantial part cross sectional view showing a glass sealed LED and a LED mounting part.

FIG. 1 is a perspective view schematically showing a light emitting device in a first preferred embodiment according to the invention and FIG. 2 is a substantial part cross sectional view showing a glass sealed LED and a LED mounting part.

As shown in FIG. 2, the glass sealed LED 2 comprises the LED element 20 composed of a GaN based semiconductor material, a $Al_2O_3$ substrate 21 mounting the LED element 20, and a glass sealing material 22 composed of a low-melting glass sealing the LED element 20.

The $Al_2O_3$ substrate 21 is composed of a $Al_2O_3$ comprising a coefficient of thermal expansion of $7.0\times10^{-6}/°$ C. And the $Al_2O_3$ substrate 21 comprises a circuit pattern 210 composed of a conducting material such as tungsten (W)—nickel (Ni)—gold (Au) and disposed in a mounting side of the LED element 20, a circuit pattern 211 composed of a same material as the circuit pattern 210 and disposed in a bottom surface of an opposite side to a mounting side of the LED element 20, and a via pattern 212 formed on via holes 212A passing through from the mounting side to the bottom surface side, and a radiation pattern 213 composed of a high conducting material and disposed on a center and bottom part of the substrate 21. Further, the circuit pattern 210 and the circuit pattern 211 are connected to each other by the via pattern 212.

The wiring substrate 4 electrically connected to the circuit pattern 211 comprises an insulating layer 40 as a base substrate, and a wiring layer 41 formed as a thin film composed of a conducting material such as a piece of copper foil on the insulating layer 40. An opening part is formed at a place of the center and bottom part of the substrate 21 where the radiation pattern 213 is positioned and a radiation path to the radiator 3 is formed by a connection of the radiation pattern 213 and the radiator 3. The insulating layer 40 can be composed of an insulating material such as polyimide and polyethylene.

The glass sealing material 22 is composed of a clear and colorless low-melted glass capable of being formed by a hot-press process at 600° C. and comprises a same coefficient of thermal expansion of $7.0\times10^{-6}/°$ C. as the LED element 20 and the $Al_2O_3$ substrate 21.

Figure 3:
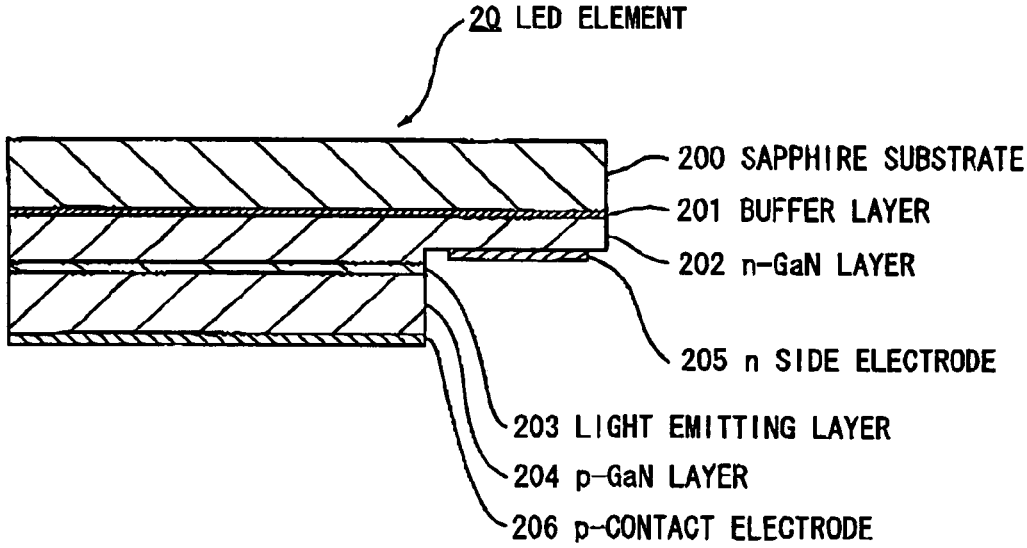
FIG. 3 is a longitudinal cross sectional view showing a LED element to be sealed by a glass.

As shown in FIG. 3, the LED element 20 is formed on a sapphire substrate 200 as a ground substrate by growing a buffer layer 201, a n-GaN layer 202, a light emitting layer 203, and a p-GaN layer 204 in order, using MOCVD (Metal Organic Chemical Vapor Deposition) method, and a n-side electrode 205 is formed on the n-GaN layer 202 exposed by removing a part of the layers from the p-GaN layer 204 to the n-GaN layer 202 by etching process. Further, a p-contact electrode 206 for electric current diffusion is formed on the p-GaN layer 204. The LED element 20 is electrically connected to the circuit pattern 210 of the $Al_2O_3$ substrate 21 through an Au stud bump 5. In the first preferred embodiment, the LED element 20 of 600 μm square is used, but the LED element 20 of up to 3 mm square can be used.

As shown in FIG. 1, the radiator 3 comprises a radiation plate 30 of 0.3 mm thickness composed of copper which is preliminarily formed by a press bending process. In the preferred embodiment, a radiation plate 30 being not bent by the press bending process is positioned at a center and four pieces of the radiation plate 30 comprising a different bending angle respectively are disposed at both sides of the center radiation plate 30 so that the radiator 3 is formed as a lamination assembly of total five pieces of the radiation plate 30. The radiation plates 30 are integrated by means that the center parts thereof are fixed at a caulking part 31 in a direction of a thickness, comprises a reflectance of 70% or more by a plate process, and whose edge parts in a width direction are respectively formed so as to be disposed like the spokes of a wheel as fins 30A. As the above, among the fins 30A spaces are retained. The radiator 3 comprises a height (a size in a direction of Z) of 50 mm. Further, the glass sealed LED 2 is mounted through the wiring substrate 4 on a top and center part shown in FIG. 1 which constitutes a side surface of each of the radiation plates 30.

A caulking part 31 is formed by a V-caulking process to the laminated radiation plates 30 using a V-shaped die so that the caulking part 31 pressed out in a V-shape achieves a friction joint of the laminated radiation plates 30. A gouge V-caulking process and a gouge-caulking process can be used instead of the V-caulking process.

Method for Making the Light Emitting Device

Hereinafter, method for making the light emitting device 1 is explained. First, copper plate materials are bent by a press bending process so that radiation plates 30 comprising a shape of each component constituting the radiator 3 are formed. Next, the radiation plates 30 are laminated in a direction of a thickness thereof so as to form a predetermined radiation shape. Next, the laminated radiation plates 30 are caulked so as to integrate a plurality of the radiation plates 30 and to form the radiator 3. Next, a wiring substrate 4 is fixed on a top surface of the radiation plate 30 with an adhesive. Next, a positioning is conduced so that a circuit pattern 211 of the glass sealed LED 2 is located at a wiring layer 41 of the wiring substrate 4, the circuit pattern 211 and the wiring layer 41 are electrically connected through an Au—Sn joint, and a radiation pattern 213 is attached firmly to the radiator 3. Next, the wiring layer 41 of the wiring substrate 4 is electrically connected to an external power supply (not shown).

Operation of the Light Emitting Device

Hereinafter, the operation of the light emitting device 1 is explained. First, when an electric power is supplied from the power supply, a power voltage is applied to the LED element 20 of the glass sealed LED 2 through the wiring layer 41 of the wiring substrate 4, so that the LED element 20 emits light at a light emitting layer 203. Simultaneously, a blue light of 470 nm wavelength passes through the glass sealing material 22 and is emitted outward in a emitting range mainly containing a direction of Z shown in FIG. 1, and a heat generated by the emission of the LED element 20 is conducted to the radiator 3 through the radiation pattern 213 constituting a bottom of the glass sealed LED 2. The radiator 3 conducts the heat conducted from the glass sealed LED 2 in a direction of a height thereof so as to perform a heat drawing and release the heat to an atmosphere from fins 30A.

Advantages of the First Embodiment

According to the first preferred embodiment of the invention, the following advantages are achieved.

(1) Radiation plates 30 composed of a high thermally-conductive plate material are integrated at the caulking part 31 and a thicker part is formed by laminating the thin plates so that a productivity of the radiator 3 can be enhanced. And, an increase and decrease of a number of the radiation plates 30 in response to a desired radiation characteristic and a change of a radiation shape are easily performed so that the radiator 3 comprising an appropriate radiation performance corresponding to a used number of the LED element 20 and an amount of heat generation can be realized. Further, the glass sealed LED 2 to be a heat source is disposed on a side surface of each of the radiation plates 30 so that the heat emitted from the LED element 20 can be directly conducted to each of the radiation plates 30. Therefore, without relation to a difference of a thermal conductivity among the radiation plates 30, a high radiation performance as well as a bulk-like heat sink comprising a branched front edge can be realized by an extremely simple method.

(2) The glass sealed LED 2 mounted on the radiator 3 is connected to the radiator 3 through the radiation pattern 213 in a good thermal conductivity so that a heat drawing performance to the heat generation accompanying the light emission can be enhanced and a stable emission performance in compliance with requirements of a high output and a large current power distribution can be provided for long periods.

(3) Edge parts in a width direction of the radiation plates 30 are disposed like the spokes of a wheel respectively so that an atmosphere radiation performance can be enhanced. Further, a novel and original appearance of the light emitting device 1 can be provided.

(4) The glass sealed LED 2 is used for a light source part so that even if a temperature rise is not kept to a degree of several 10° C., an electrical breaking by a stress due to a temperature change because of a large coefficient of thermal expansion like a sealing resin, and a reduction of light volume due to a lowering of transparency of the components can not be caused. Therefore, even if a radiation performance of the radiator 3 is identical, a case of using the glass sealing can realize a high output by using a lager electric power than a case of using the resin sealing.

Further, in the first preferred embodiment, as a light source the glass sealed LED 2 using a blue LED element 20 emitting a blue light has been explained, but a glass sealed LED 2 using the LED element 20 emitting lights other than the blue light can be adopted.

And, as the glass sealing material 22, a composition can be adopted, the composition being formed by dispersing a phosphor material emitting a yellow light by being excited by a blue light such as YAG (Yttrium Aluminum Garnet) to a low-melting glass, or comprising a wavelength conversion part disposed in a low-melting glass as a phosphor layer and emitting a white light due to a mixture of the blue light and the yellow light.

And, as a glass sealed LED 2 emitting a white light, a composition can be adopted, the composition using an ultraviolet light LED element emitting an ultraviolet light of 370 nm wavelength and realizing a white light by making the light pass through a phosphor layer composed of a RGB phosphor material formed on the glass sealing material 22 in a form of laminae.

Further, the light source part is not limited to the glass sealed LED 2, but a resin sealing type package comprising a resin such as a silicone resin as a sealing material can be mounted.

The radiator 3 may be formed integrating the radiation plates 30 formed of an aluminum material, instead of a copper material, by the caulking part 31, and further the radiator 3 may be formed by a material comprising a same thermal conductivity as the materials described above. Further, the thermal conductivity of 150 W/m·k or more is more preferable. And, a method of the integration of the radiation plates 30 is not limited to the caulking connection described above, but an electrical weld, and a solder connection such as a soldering and a brazing filler material connection can be used.

Figure 4:
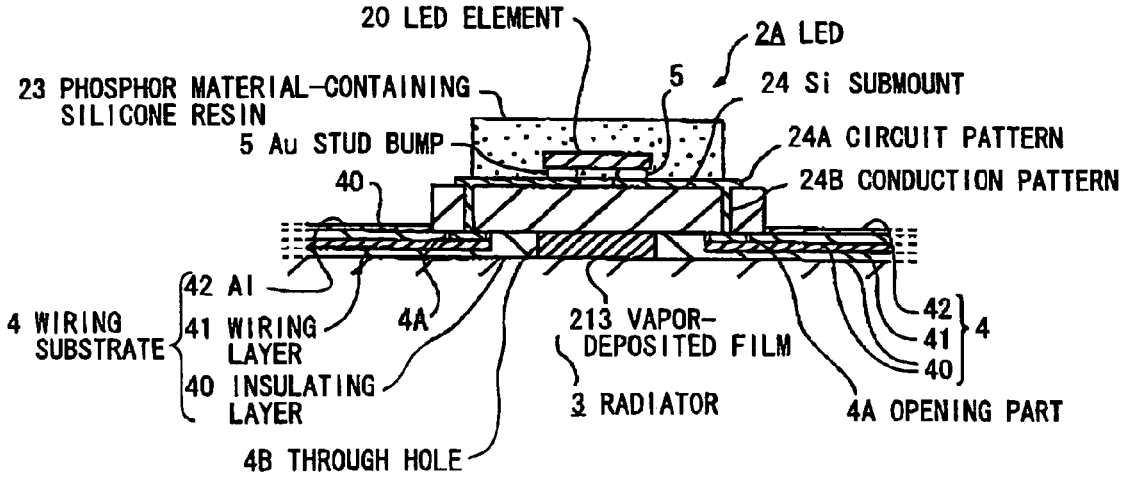
FIG. 4 is a substantial part cross sectional view showing a LED as a substituting light source for the glass sealed LED.

FIG. 4 is a substantial part cross sectional view showing a LED as a substituting light source for the glass sealed LED.

The LED 2A comprises a phosphor material-containing silicone resin 23 sealing the LED element 20 and a circuit pattern 24A mounting the LED element 20 and is disclosed on the wiring substrate 4.

The phosphor material-containing silicone resin 23 is formed by mixing a YAG phosphor material to a silicone resin and constitutes a wavelength converter generating a white light due to a mixture of a blue light emitted from the LED element 20 and a yellow light generated by being excited by the blue light.

The Si submount 24 comprises a circuit pattern 24A disposed in a mounting side of the LED element 20, a conduction pattern 24B electrically connected to the circuit pattern 24A and disposed in via holes formed so as to pass through the submount 24, and a radiation pattern 213 disposed on the opposite side to a mounting side of the LED element 20.

The wiring substrate 4 comprises an insulating layer 40, a wiring layer 41, and an Al vapor-deposited film 42 disposed on a surface of the insulating layer 40 as a light reflecting layer, and an opening part 4A is formed in the insulating layer 40 so that the conduction pattern 24B of the LED 2A and the wiring layer 41 are electrically connected to each other. Further, through holes 4B are formed so that the radiation pattern 213 disposed in the Si submount 24 can butt against the radiator 3.

Even if the LED 2A of a resin sealing type described above is used as a light source, a heat accompanying an emission of the LED element is conducted to the radiator 3 efficiently, so that even a continuous lighting for long time, a stable emission performance can be maintained.

Second Embodiment

Composition of Light Emitting Device

Figure 5:
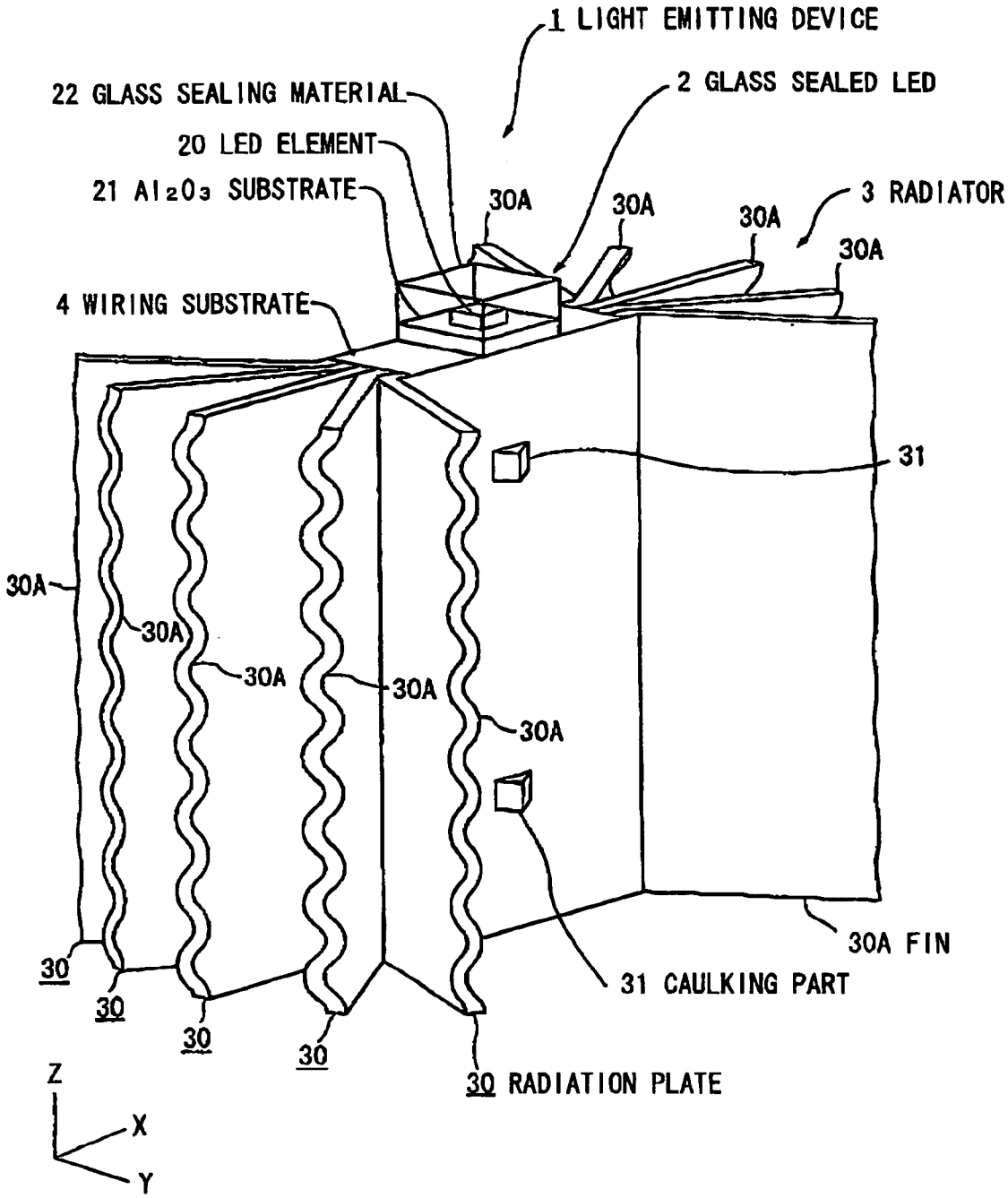
FIG. 5 is a perspective view schematically showing a light emitting device in a second preferred embodiment according to the invention.

FIG. 5 is a perspective view schematically showing a light emitting device in a second preferred embodiment according to the invention. In the following explanation, as to a part comprising same composition and function as used in the first preferred embodiment, same references are used.

The light emitting device 1 comprises a radiator with fins 30A explained in the first preferred embodiment of which edge parts are formed to a corrugated plate and compositions other than the composition of the fin 30A are same as the first preferred embodiment.

Advantages of the Second Embodiment

According to the second preferred embodiment of the invention, the edge parts of the fins 30A are formed to a corrugated plate so that a radiation area can be enlarged and a radiation performance can be enhanced. Further, plates for the fins 30A are not limited to the corrugated plate described above, but an embossed plate can be used.

Third Embodiment

Composition of Light Emitting Device

Figure 6:
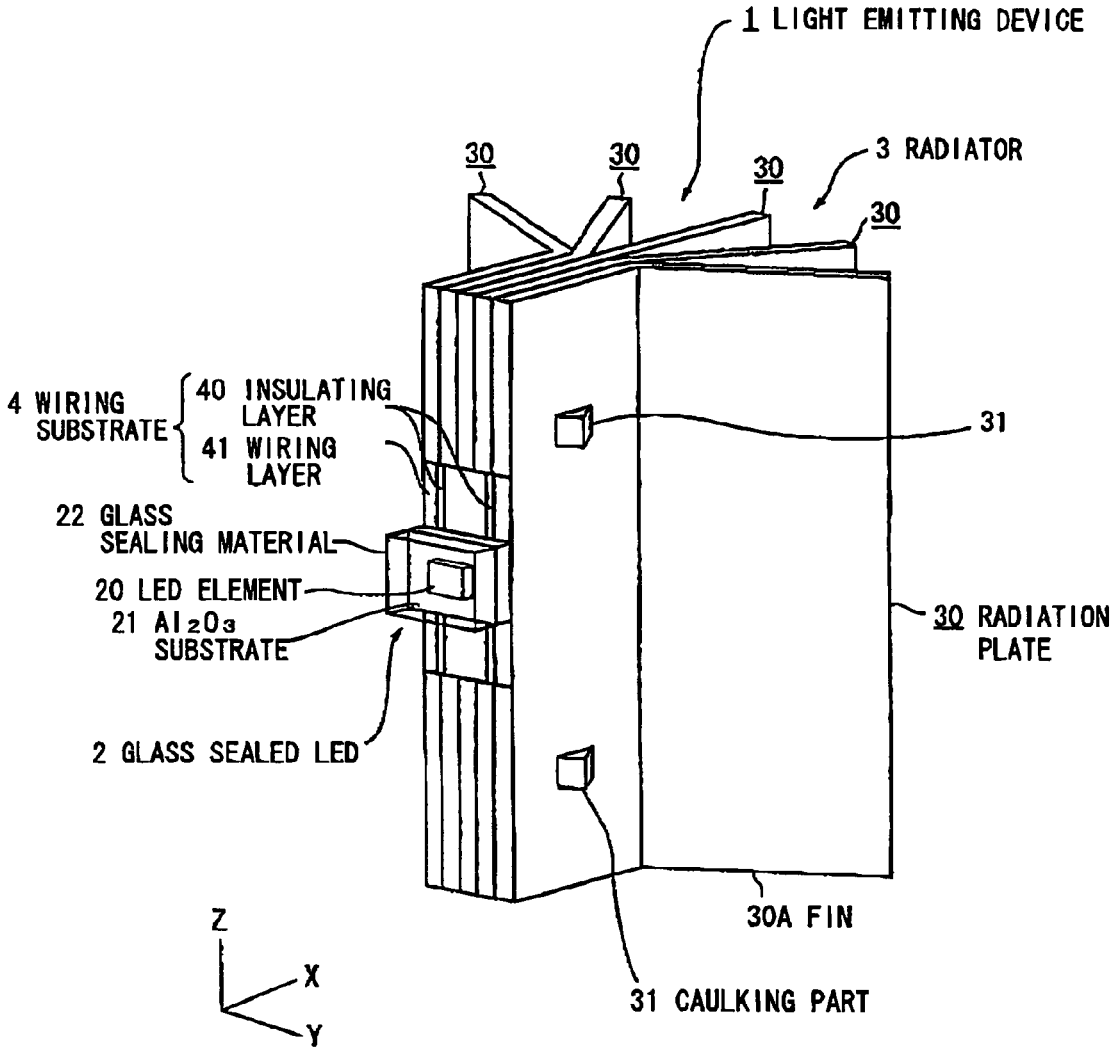
FIG. 6 is a perspective view schematically showing a light emitting device in a third preferred embodiment according to the invention.

FIG. 6 is a perspective view schematically showing a light emitting device in the third preferred embodiment according to the invention.

The light emitting device 1 of the preferred embodiment comprises a glass sealed LED 2 mounted on a side surface of the radiator 3 so as to emit a light in a direction of X corresponding to a direction of a light axis of the LED element 20. The radiator 3 in the third preferred embodiment is formed by cutting the radiator 3 explained in the first preferred embodiment at a center part in a longitudinal direction so that a side surface composed of the cutting surface formed by the cutting of the radiator 3 constitutes a mounting surface of the glass sealed LED 2. Further, a Z direction shown in FIG. 6 represents a direction of a natural convection which generates in a vertical direction in a calm condition by that the radiation plates 30 become higher temperature than an air of circumference, or represents a flowing direction of the air of circumference.

Advantages of the Third Embodiment

According to the third preferred embodiment of the invention, a thicker part formed by laminating the thin plates is exposed in a direction of a side surface of the radiator 3 so that a high output light can be emitted in the X direction other than the Z direction explained in the second preferred embodiment. Further, the radiation plates 30 of the radiator 3 are formed in a direction suitable for an air cooling so that a high radiation performance can be realized. Therefore, due to a high heat drawing performance, a stable emission performance can be provided for long time. Further, an edge part of the fin 30A can be formed to the corrugated plate as explained in the second preferred embodiment.

Further, a case that only one glass sealed LED 2 is mounted as a light source has been explained, but being not limited to the case, a case that a plurality of the glass sealed LED 2 are mounted in the Z direction can be adopted.

Fourth Embodiment

Composition of Light Emitting Device

Figure 7:
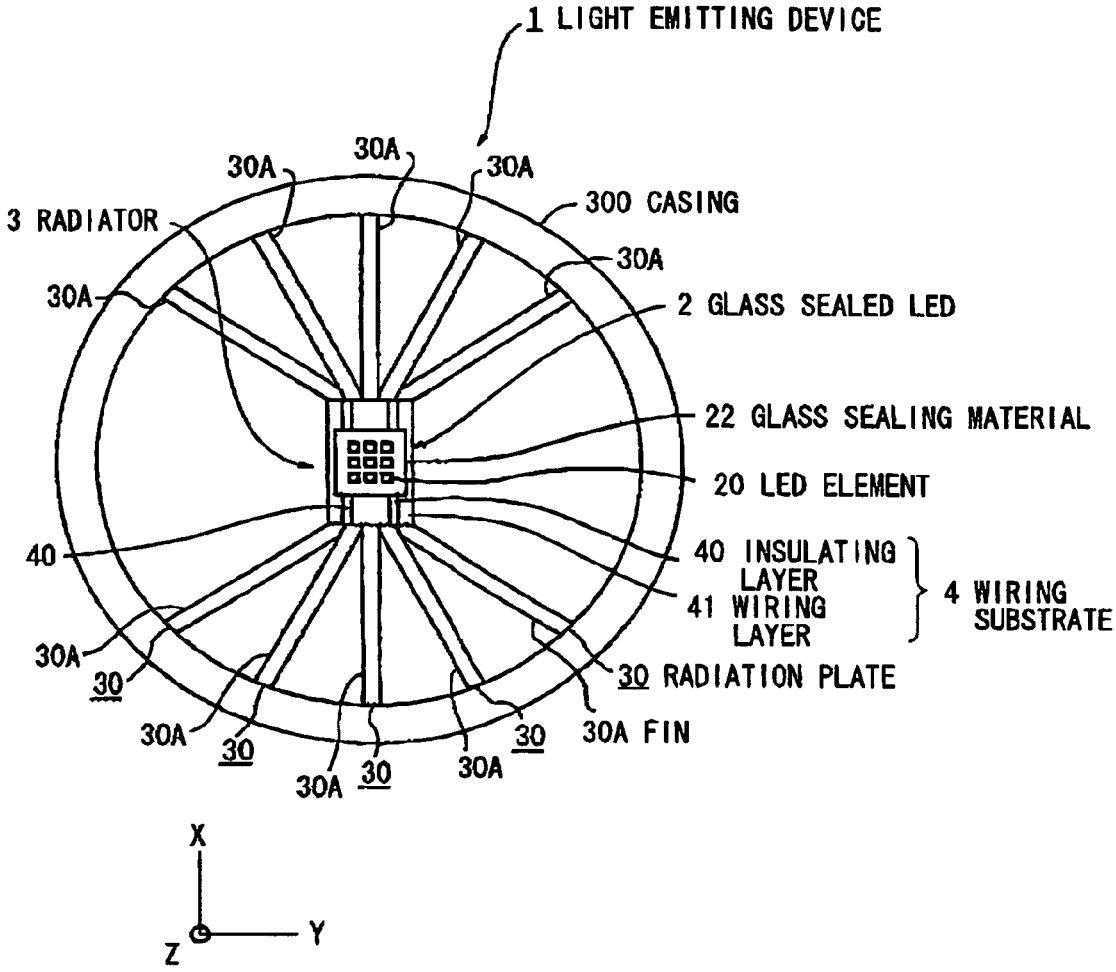
FIG. 7 is a plain view schematically showing a light emitting device seen from its light extraction side in a fourth preferred embodiment according to the invention.
Figure 8:
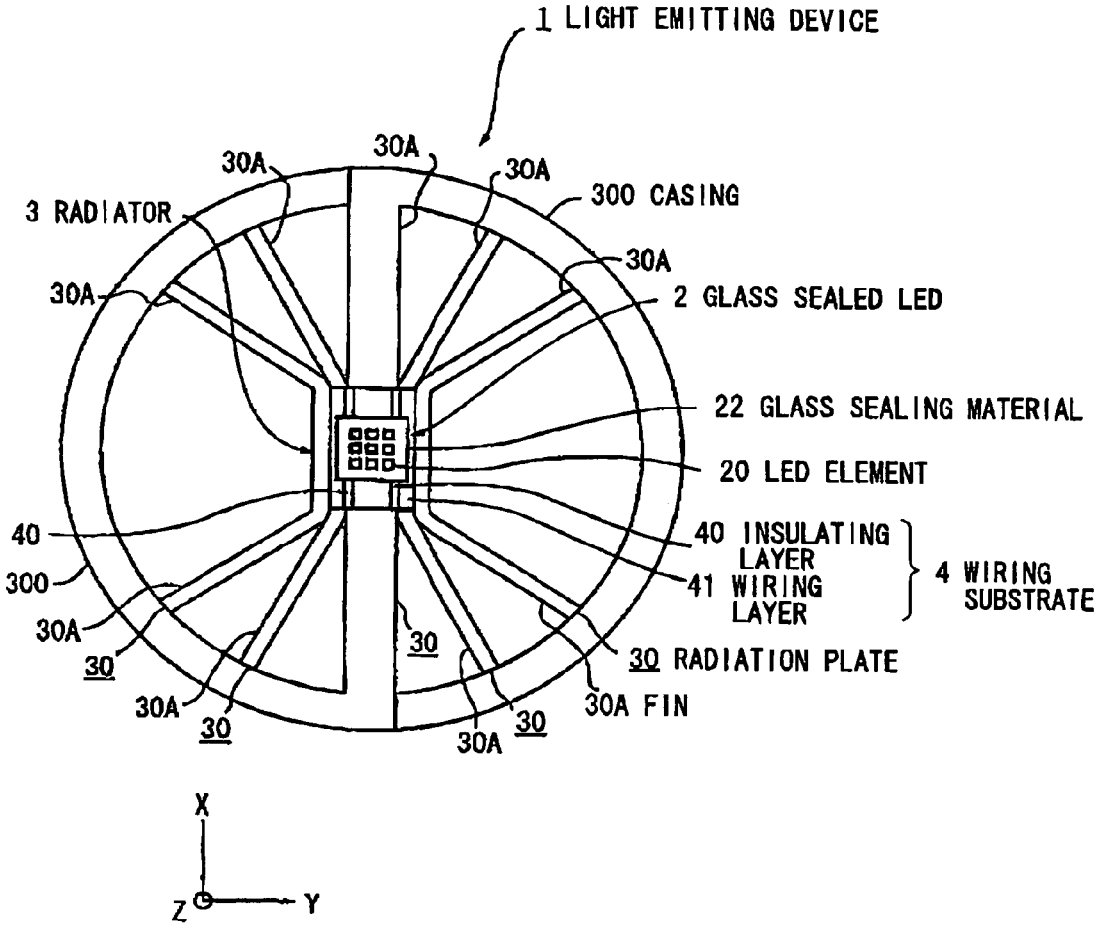
FIG. 8 is a plain view schematically showing a light emitting device seen from its light extraction side in a fifth preferred embodiment according to the invention.

FIG. 7 is a plain view schematically showing a light emitting device seen from its light extraction side in the fourth preferred embodiment according to the invention.

The light emitting device 1 of the preferred embodiment comprises a glass sealed LED 2 mounted on the radiator 3 explained in the second preferred embodiment, the glass sealed LED 2 comprising nine pieces of blue LED elements 20 sealed by the glass sealing material 22, and further comprises a cylindrical casing 300 composed of a steel material of 1 mm thickness disposed outside of the fins 30A. The casing 300 is connected to the fins 30A through the Au—Sn joint.

Advantages of the Fourth Embodiment

According to the fourth preferred embodiment of the invention, the casing 300 is not located at an outward emitting path of a light emitted from the LED element 20 and the radiator 3 is housed in the casing 300 so that the casing 300 can be formed as a thick wall, the fins 30FA can be prevented from a change of shape, and since an effect of leading an air is enlarged a radiation performance can be enhanced. As shown in FIG. 7, even in a case of using a glass sealed LED 2 of a high brightness type mounted a plurality of the LED elements 20 of a standard size (300 mm square), a radiation performance can be performed without deficiency, a high heat drawing performance can be achieved, and a stable emission performance can be provided for long time.

Fifth Embodiment

Composition of Light Emitting Device

FIG. B is a plain view schematically showing a light emitting device seen from its light extraction side in the fifth preferred embodiment according to the invention.

The light emitting device 1 of the preferred embodiment comprises a glass sealed LED 2 mounted on the radiator 3 composed of the radiation plates of 1 mm thickness and the radiation plates of 0.3 mm thickness, the glass sealed LED 2 comprising nine pieces of blue LED elements 20 explained in the fourth preferred embodiment. And further the thicker radiation plates 30 constitute a casing 300 of which edge parts surround a circumference of the radiator 3 in a cylindrical shape.

Advantages of the Fifth Embodiment

According to the fifth preferred embodiment of the invention, the thicker radiation plates 30 constituting the radiator 3 is folded in the circumference of the radiator 3 so that the casing 300 can be formed in an integrated condition and a light emitting device 1 comprising a high mechanical strength can be realized, in addition to the advantages shown in the fourth preferred embodiment.

Sixth Embodiment

Composition of Light Emitting Device

Figure 9:
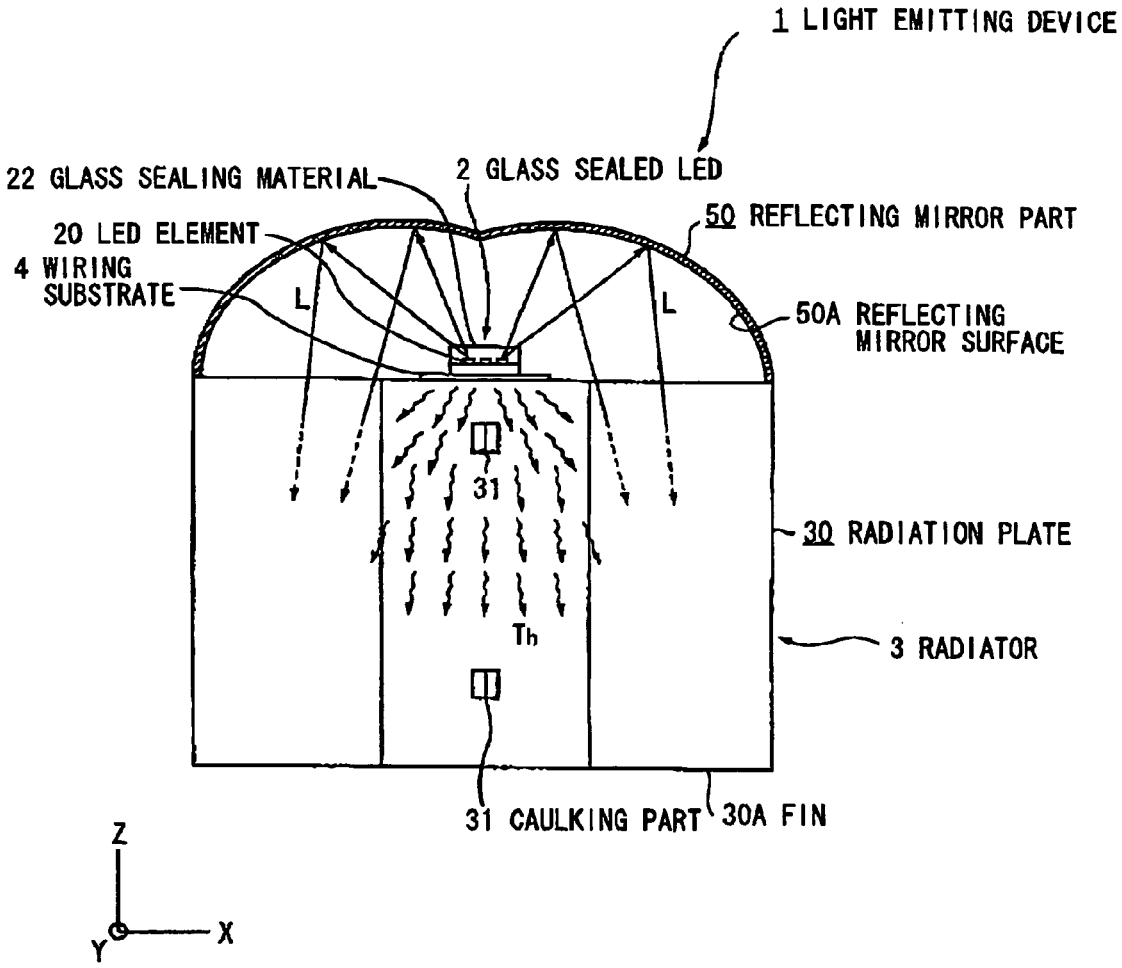
FIG. 9 is a longitudinal cross sectional view showing a light emitting device in a sixth preferred embodiment according to the invention.

FIG. 9 is a longitudinal cross sectional view showing a light emitting device in the sixth preferred embodiment according to the invention.

The light emitting device 1 of the preferred embodiment comprises a reflecting mirror part 50 disposed on its light extraction side of the light emitting device 1 as explained in the fourth preferred embodiment, formed of an aluminum plate, formed to have a paraboloid of revolution with the glass sealed LED 2 located at its focus, and facing the light source. Its reflecting mirror surface 50A facing the light source reflects a light emitted from the glass sealed LED 2 to lead the light, along the radiation plates 30, to the back surface side of the glass sealed LED 2 so that the light can be taken out to the opposite side in the Z direction.

Advantages of the Sixth Embodiment

According to the sixth preferred embodiment of the invention, in addition to the advantages of the first to the fifth preferred embodiments, the light emitting device 1 of a light reflecting type to offer a high radiation performance and a high external emission efficiency can be obtained. The light reflected on the reflecting mirror surface 50A passes through a space inside the radiator 3 along the radiation plates 30, and is emitted to the outside of the casing 300.

For example, when the glass sealed LED 2 to emit a white light is mounted on the radiator 3 and is turned on, light reflected on the reflecting mirror surface 50A can be emitted to the outside of the casing 300 without any color separation since the reflecting mirror does not cause the problem that its refracting angle becomes different depending on wavelengths due to lens effect. Thus, the light emitting device 1 can emit a white light with a high quality as well as a high brightness.

Further, the reflecting mirror part 50 facing the light source is formed to have a paraboloid of revolution with the glass sealed LED 2 located at the focus to externally emit parallel lights. When the radiation plates 30 are bent perpendicularly to the Z axis, the light can be externally emitted in parallel. The shape of the reflecting mirror part 50 helps the light emit in the direction along the radiation plates 30 so that the ratio of lights reaching the radiation plates 30 can be minimum and the light loss due to the metal reflection absorption can be reduced. Thus, the external emission efficiency can be maximized. Alternatively, in order to enlarge the distribution of light externally emitted, the reflecting mirror part 50 may be formed to have an ellipsoid of revolution. Further, in order to have a wider light distribution in the X or Y direction, the reflecting mirror part 50 may be formed to have an ellipsoid surface instead of the ellipsoid of revolution. Thus, the shape thereof can be suitably changed according to the use. Although the reflecting mirror part 50 is formed of the aluminum plate in the above embodiment, the reflecting mirror part 50 can be formed of a resin with Ag or Al deposited thereon to form a mirror surface.

Seventh Embodiment

Composition of Light Emitting Device

Figure 10:
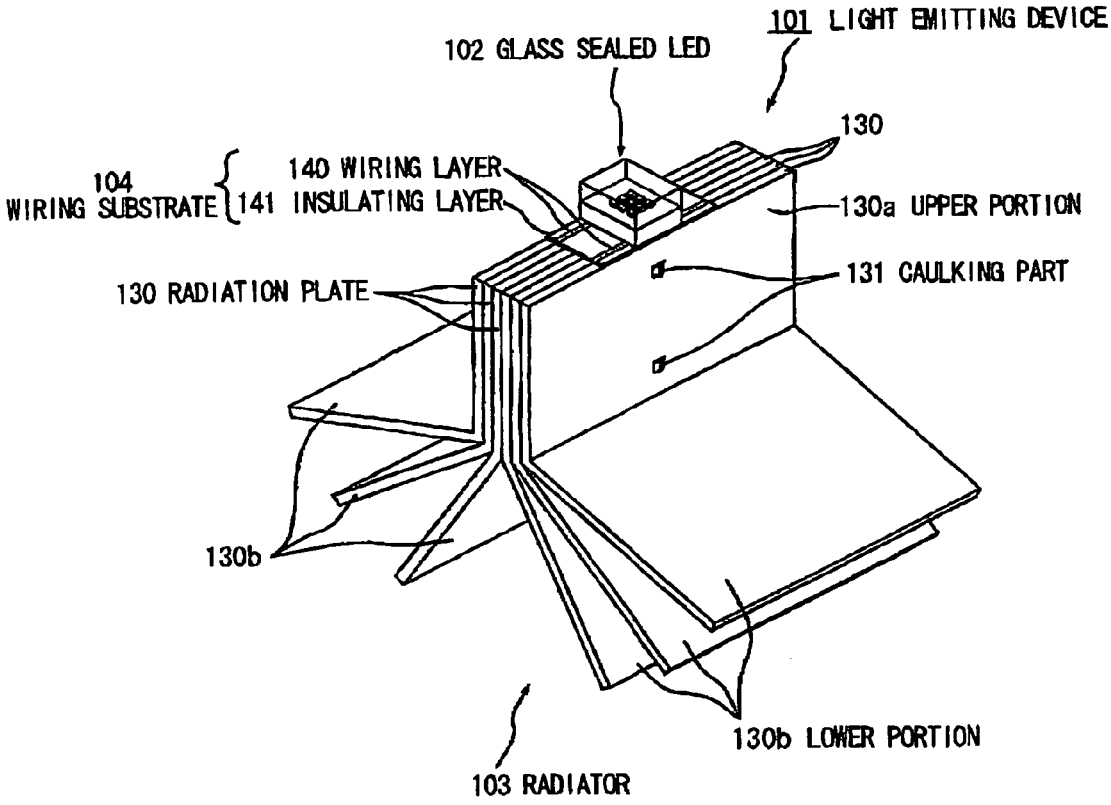
FIG. 10 is a perspective view showing a light emitting device in a seventh preferred embodiment according to the invention.

FIG. 10 is a perspective view schematically showing a light emitting device in a seventh preferred embodiment according to the invention.

As shown in FIG. 10, the light emitting device 101 comprises a glass sealed LED 102 formed by sealing a plurality of LED elements 20 with a glass as a light source, and a radiator 103 comprising radiation plates 130 composed of a high thermally-conductive plate material and integrated at a caulking part 131. That is, the radiator 103 comprises a plurality of the radiation plates 130 which are connected together so that at least a part thereof is disposed apart from each other. The glass sealed LED 102 are fixed on a top surface of the radiator 103 and is electrically connected to a wiring layer 140 of a wiring substrate 104 disposed on the top surface of the radiator 103.

Figure 11:
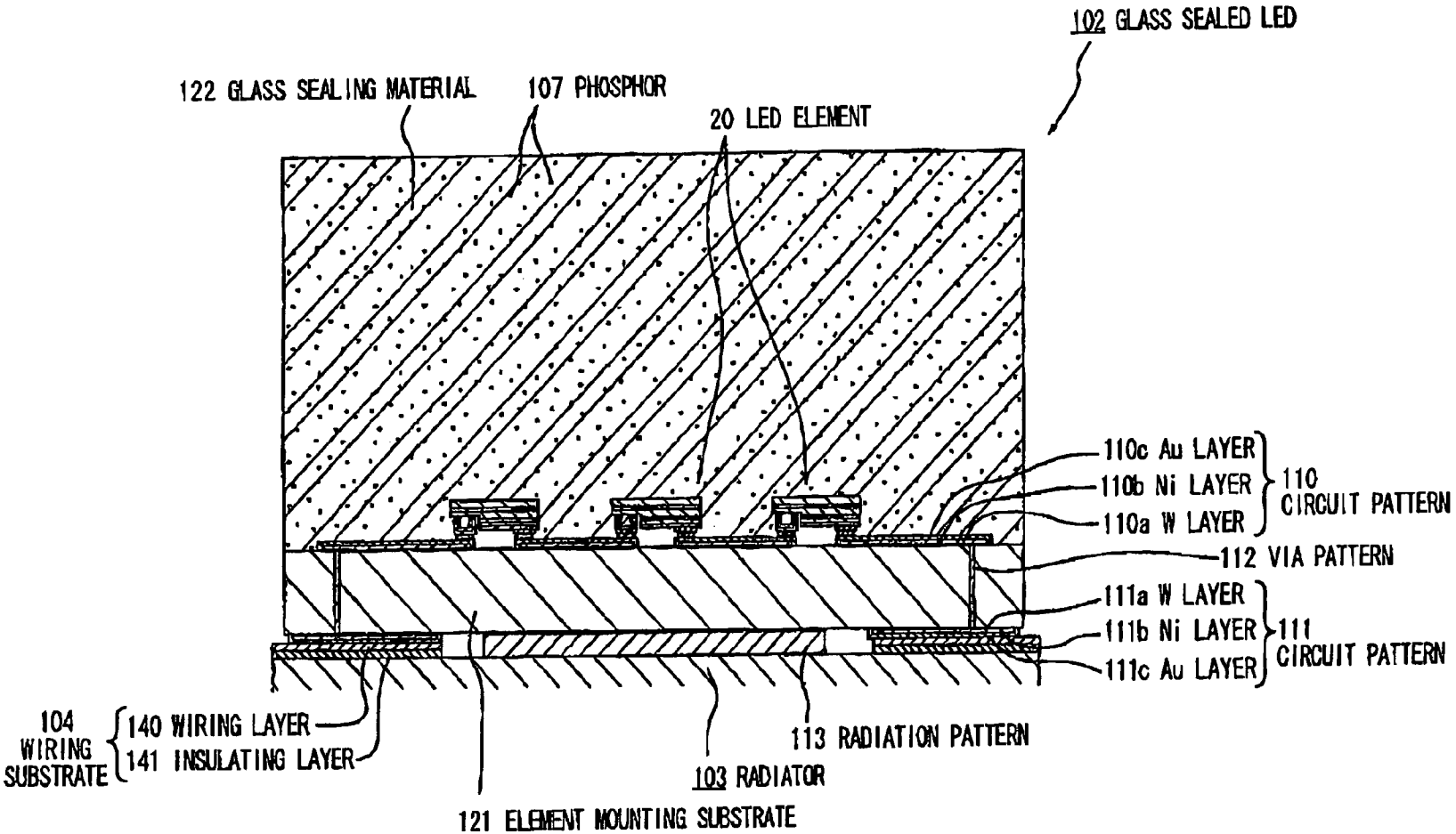
FIG. 11 is an enlarged cross sectional view showing a glass sealed LED and its mounting portion in FIG. 10.

FIG. 11 is a substantial part cross sectional view showing a glass sealed LED and a LED mounting part.

As shown in FIG. 11, the glass sealed LED 102 comprises a plurality of LED elements 20 of a flip-chip type composed of GaN based semiconductor material, and an element mounting substrate 121 for mounting a plurality of LED elements 20, the substrate 121 comprising a multilayer structure. Further, the glass sealed LED 102 comprises a circuit pattern 110 on a front surface, a circuit pattern 111 on a back surface and via patterns 112, on both surfaces of and in a layer of the element mounting substrate 121 composed of a $Al_2O_3$ of 0.25 mm thickness. The circuit patterns 110, 111 are comprise W layers 110*a*, 111*a* formed on the surfaces of the element mounting substrate 121, and Ni layers 110*b*, 111*b* and Au layers 110*c*, 111*c* formed by plating on surfaces of the W layers 110*a*, 111*a*. Further, on an opposite surface to a mounting surface of the element mounting substrate 121 a radiation pattern 113 radiating a heat generated in each of the LED elements 20 is formed by a metallization. The radiation pattern 113 is formed by a same process as the circuit pattern 111. And the glass sealed LED 102 comprises a glass sealing material 122 containing a phosphor 107, the material 122 sealing each of the LED elements 20 and being bonded to the element mounting substrate 121.

As shown in FIG. 10, the LED elements 20 are disposed in a length and width arrangement of three pieces×three pieces and the LED elements 20 of total 9 pieces are mounted on the element mounting substrate 121. In the embodiment the LED element 20 comprises a size of 0.34 mm square in a planar viewing and a distance therebetween of 600 μm in a length and width direction, and the glass sealed LED 102 comprises a size of 2.7 mm square in a planar viewing. That is, a thickness of the element mounting substrate 121 is set thinner than a mounting interval of the LED element 20. And an area in a planar viewing of the glass sealed LED 102 is set ten times or less of a total area of a plurality of the LED elements 20. A p-side electrode of the LED element 20 comprises an ITO electrode and two pieces of a relatively small p-side pad electrode. Further, in the glass sealed LED 102 the element mounting substrate 121 and the glass sealing material 122 comprise a coefficient of thermal expansion of being small together and equal to each other, and are bonded together by a chemical bonding or an anchor effect, so that even if the bonding area is small a separation as generated in a resin sealed LED can be prevented.

The wiring substrate 104 connected to the circuit pattern 111 on the back surface comprises an insulating layer 141 as an insulating material and a wiring layer 140 formed on the insulating layer 141 to a film of a conductive material such as a copper foil, and comprises an opening at a region where a radiation pattern 113 mounted on a center and under portion of the element mounting substrate 121 is disposed. And, the radiation pattern 113 is fixed to the radiator 103, so that a radiation path to the radiator 103 is formed. The insulating layer 141 is composed of for example insulating materials such as polyimide, polyethylene.

The glass sealing material 122 is composed of a thermal adhesive glass capable of being formed by a hot pressing process at 600° C. comprising a transparent and colorless property and a low melting point, and comprises a coefficient of thermal expansion of $6.0\times10^{-6}$/° C. which is equal to a coefficient of thermal expansion of the LED elements 20 and the element mounting substrate 121. That is, the glass sealing material 122 comprises a coefficient of thermal expansion near to the LED element 20 in comparison with resin materials such as an epoxy resin, a silicone resin. In the embodiment a $ZnO—SiO_2—R_2O$ based glass (R is at least one element selected from I group elements) is used as the glass sealing material. In the glass sealing material 122 the phosphor 107 is dispersed.

The phosphor 107 is a yellow phosphor emitting a yellow light comprising a peak wavelength in a yellow region when it is excited by a blue light emitted from a light emitting layer 203 of the LED elements 20. In the embodiment a YAG (Yttrium Aluminum Garnet) phosphor is used as the phosphor 107. Further, the phosphor 107 can be a silicate phosphor or a mixture of the YAG and the silicate phosphor at a predetermined proportion etc.

Figure 12:
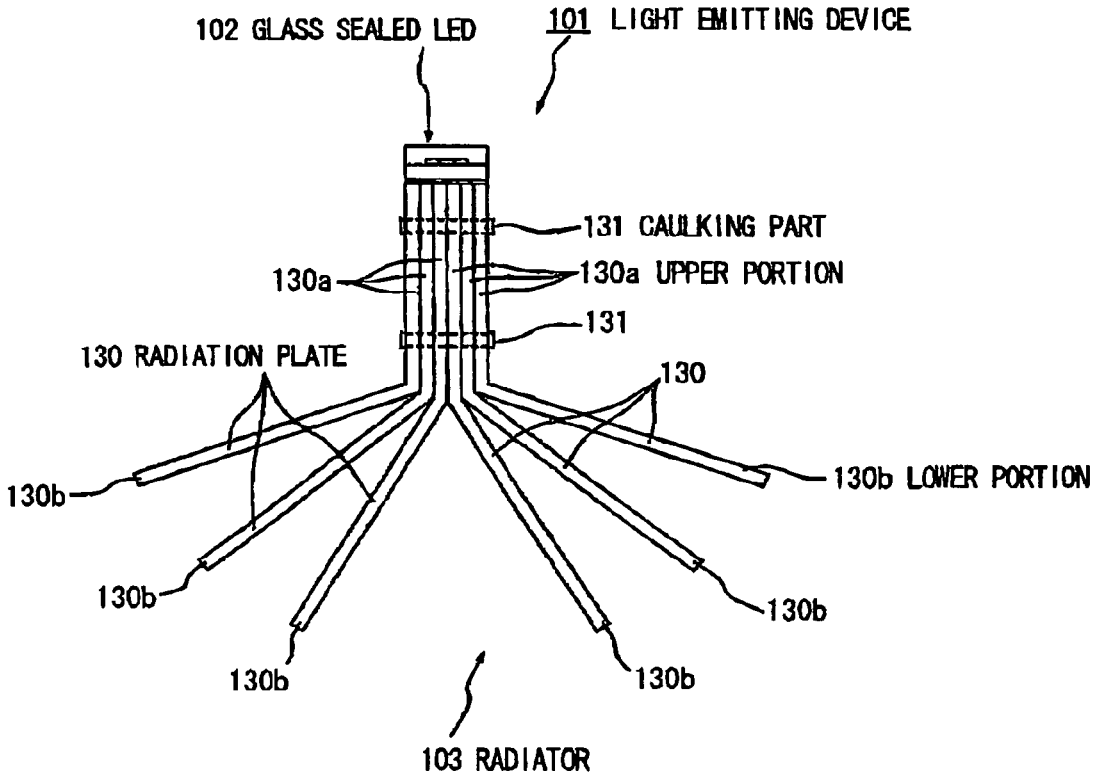
FIG. 12 is a front view showing the light emitting device in FIG. 10.

The radiator 103 comprises a plurality of radiation plates 130 composed of copper of 0.3 mm thickness. In the embodiment an oxygen free copper comprising a thermal conductivity of 400 W/m·K as the radiation plate 130 is used. Each of the radiation plates 130 comprises an upper portion 130*a* whose surface faces in a left and right direction of and a lower portion 130*b* which slopes from a lower end of the upper portion 130*a* outward in the left and right direction and extends obliquely downward. Each of the radiation plates 130 is preliminarily formed by a press bending process, as shown in FIG. 12, bending angles thereof are predetermined, so that the lower portions 130*b* of the radiation plates 130 are apart from each other at a side of the lower ends. In the embodiment three pairs and total six pieces of the radiation plate are laminated at the upper portion 130*a* so that the lower portions 130*b* form together symmetrical angles in the left and right direction.

Each of the radiation plates 130 is integrally fixed by a pair of caulking parts 131 in a vertical direction passing through each of the upper portions 130*a* in a direction of a thickness. Each of the radiation plates 130 comprises a reflectance of 70% or more due to a plating processing thereto, and the lower portions 130*b* of the radiation plates 130 are disposed like the spokes of a wheel with a central focus on joined portions thereof.

The caulking parts 131 are formed by a V-caulking process to the laminated radiation plates 130 using a V-shaped die so that the caulking part 131 pressed out in a V-shape achieves a friction joint of the laminated radiation plates 130. Further, a caulking method of forming the caulking parts 131 is optional, so that a gouge V-caulking process and a gouge-caulking process can be used for joining the radiation plates 130 instead of the V-caulking process.

Method for Making of the Light Emitting Device

Hereinafter, method for making of a light emitting device 101 is explained. First, copper plate materials are bent by a press bending process so that radiation plates 130 comprising the upper portion 130*a* and the lower portion 130*b* are formed. Next, the radiation plates 130 are laminated at the upper portion 130*a* in a direction of a thickness thereof, and the laminated radiation plates 130 are caulked so as to integrate a plurality of the radiation plates 130 and to form the radiator 103. Next, a wiring substrate 104 is fixed on a top surface of each of the radiation plates 130 with an adhesive. Next, a positioning is conducted so that a circuit pattern 111 of the glass sealed LED 102 is located at a wiring layer 140 of the wiring substrate 104, the circuit pattern 111 and the wiring layer 140 are electrically connected though the Au—Sn joint, and a radiation pattern 113 is attached firmly to the radiator 103. Next, the wiring layer 140 of the wiring substrate 104 is electrically connected to an external power supply (not shown).

Operation of the Light Emitting Device

Hereinafter, an operation of a light emitting device 101 is explained. First, when an electric power is supplied from the power supply, a power voltage is applied to the LED element 20 of the glass sealed LED 102 through the wiring layer 140 of the wiring substrate 104, so that the LED element 20 emits light at a light emitting layer 203. Simultaneously, a blue light of 470 nm wavelength passes through the glass sealing material 122 and is emitted outward in a emitting range mainly containing an upper direction, and a heat generated by the emission of the LED element 20 is conducted to the radiator 103 through the radiation pattern 113 constituting a bottom of the glass sealed LED 102. The radiator 103 conducts the heat conducted from the glass sealed LED 102 in a direction of a height thereof so as to perform a heat drawing and release the heat to an atmosphere from the lower portion 130*b*.

Advantages of the Seventh Embodiment

According to a seventh preferred embodiment of the invention, the following advantages are achieved.

(1) The glass sealed LED 102 comprises a structure that a plurality of the LED elements 20 are mounted, so that an interaction of a heat in the elements can be decreased in comparison with a structure that a LED element of a large size are mounted, and a heat resistance can be reduced. That is, the LED element of a large size are identified with a structure that a plurality of LED elements contact with each other, so that even if an amount of radiation to the element mounting substrate 121 per an element area is even, the structure that a plurality of the LED elements are disposed at a certain interval can keep a temperature elevation of the LED elements 20 lower. In addition to the above, the glass sealing material 102 comprising a small coefficient of thermal expansion and not generating a tensile tension to the LED elements 20 due to an expansion of the sealing material even in a high temperature is used, so that the LED element 20 comprising a small mounting strength can be used. And a p-side electrode of each of the LED elements 20 comprises an ITO electrode and a relatively small p-side pad electrode formed on the ITO electrode, and the LED element 20 is mounted by total two pieces of bumps composed of a piece of anode and a piece of cathode, so that the LED element 20 comprises a light emitting efficiency higher than conventional elements mounted by three pieces or more of bumps.

(2) A heat is drawn through the radiation pattern 113 constituting a bottom of the glass sealed LED 102, so that an interaction of a heat between the LED elements 20 can be decreased, and also by this a heat resistance can be reduced. In particular, a thickness of the element mounting substrate 121 is set thinner than a mounting interval of the LED element 20, so that a heat generated in the LED elements 20 is conducted to a direction of the radiation pattern 113 more than to a direction of neighboring LED elements 20. Therefore, also by this a light emitting efficiency can be enhanced.

(3) The glass sealed LED 102 is mounted by the Au—Sn joint with a relatively high thermal conductivity, so that a diffusion efficiency to the radiator 103 becomes higher in comparison with a plating process. And the glass sealed LED 102*a* is heated up to 300 to 350° C. in the Au—Sn mounting, but a glass sealing material 122 is not changed in quality since the temperature is within an allowable temperature limit of the glass sealing material 122. Further, the glass sealing material 122 is not changed in quality when the temperature is below a glass transition temperature (Tg point). Therefore, when the mounting can be performed at a temperature below the glass transition temperature, even if materials other than the Au—Sn are used, a similar effect can be obtained. As described above, a mounting at 200° C. or more can be realized which can not be achieved by a conventional mounting using resins such as a silicone resin, an epoxy resin.

(4) Radiation plates 130 composed of copper plates comprising a high thermal-conductivity are integrated at the caulking part 131 and a thicker part is formed by laminating the thin plates, so that a productivity of the radiator 103 formed to a fin shape and increasing a thickness from one end side to another end side can be enhanced. And, an increase and decrease of a number of the radiation plates 130 and a change of a radiation shape in response to a desired radiation characteristic are easily performed, so that the radiator 103 comprising an appropriate radiation performance corresponding to a used number of the LED element 20 and an amount of heat generation can be realized. Further, the glass sealed LED 102 to be a heat source is disposed on an end surface of each of the radiation plates 130, so that the heat emitted from the LED element 20 can be directly conducted to each of the radiation plates 130. Therefore, without relation to a difference of a thermal conductivity among the radiation plates 130, a high radiation performance equal to a bulk-like heat sink comprising a branched front edge can be realized by an extremely simple method. That is, there is a problem in a conventional heat sink composed of aluminum etc. that it is difficult to form to a thick wall and a long size because of an integral forming, and difficult to form to a complex shape while the radiating system becomes large, but the light emitting device 101 can solve the problem.

(5) The lower portions 130*b* of each of the radiation plates 130 is disposed like the spokes of a wheel, so that a surface area of the radiator 103 can be enlarged and a heat can be efficiently diffused from the radiator 103 while the radiator 103 can be reduced in size and weight. Further, a novel and original appearance of the light emitting device 101 can be provided.

(6) The glass sealed LED 102 is used for a light source part so that even if a temperature rise is not kept to a degree of several 10° C., an electrical breaking by a stress due to a temperature change as a sealing by a sealing resin comprising a relatively large coefficient of thermal expansion can not be caused, and a reduction of light volume due to a lowering of transparency of the sealing materials can not be caused. Therefore, even if a radiation performance of the radiator 103 is identical, a case of using the glass sealing can realize a high output by using a lager electric power than a case of using the resin sealing. Experiments by the inventors have confirmed that even if a current of 100 mA is applied to the LED elements 20 to which usually a current of 20 mA is applied and a continuous lighting is performed during 2000 hours at an atmosphere of 100° C., the light volume is not reduced.

Further, in the seventh preferred embodiment, a case that the light emitting device 101 comprises the blue LED elements 20 emitting a blue light as a light source, and the glass sealing material 122 in which the yellow phosphor 107 is dispersed, so as to obtain a white light by combining a blue light and a yellow light has been explained as an example, but for example the light emitting device 101 realizing a white light by combining an ultraviolet light LED element emitting an ultraviolet light, and a red phosphor, or a green phosphor and an red phosphor can be adopted. Further, the invention can be applied to the light emitting device not using the phosphors, and directly using an emitting color of the LED element such as an ultraviolet, a violet, a blue, a green, a red LED element etc.

And in the seventh preferred embodiment, a case that the radiation plates 130 are composed of a copper has been explained, but the radiation plates 130 can be composed of for example brass (thermal conductivity of 100 W/m·k), and aluminum (thermal conductivity of 230 W/m·k). The radiation plate 130 comprising a high thermal conductivity is preferable. The radiation plate 130 composed of materials comprising the thermal conductivity of 100 W/m·k or more is more preferable. And, a method of the integration of the radiation plates 130 is not limited to the caulking connection described above, but an electrical weld, and a solder connection such as a soldering and a brazing filler material connection can be used.

And in the seventh preferred embodiment, a case that the circuit pattern 111 and the wiring layer 140 are electrically connected through the Au·Sn joint has been explained, but they can be connected by the solder connection, and the connection method is optional. Further, the radiator 103 is plated with Au or Au·Sn and the radiation pattern 113 of the LED element 20 and the radiator 103 can be connected by an ultrasonic bonding. The resin sealed LED can not transmit the ultrasonic wave to the connection portion, but the glass sealed LED 102 can transmit the ultrasonic wave to the connection portion.

Figure 13:
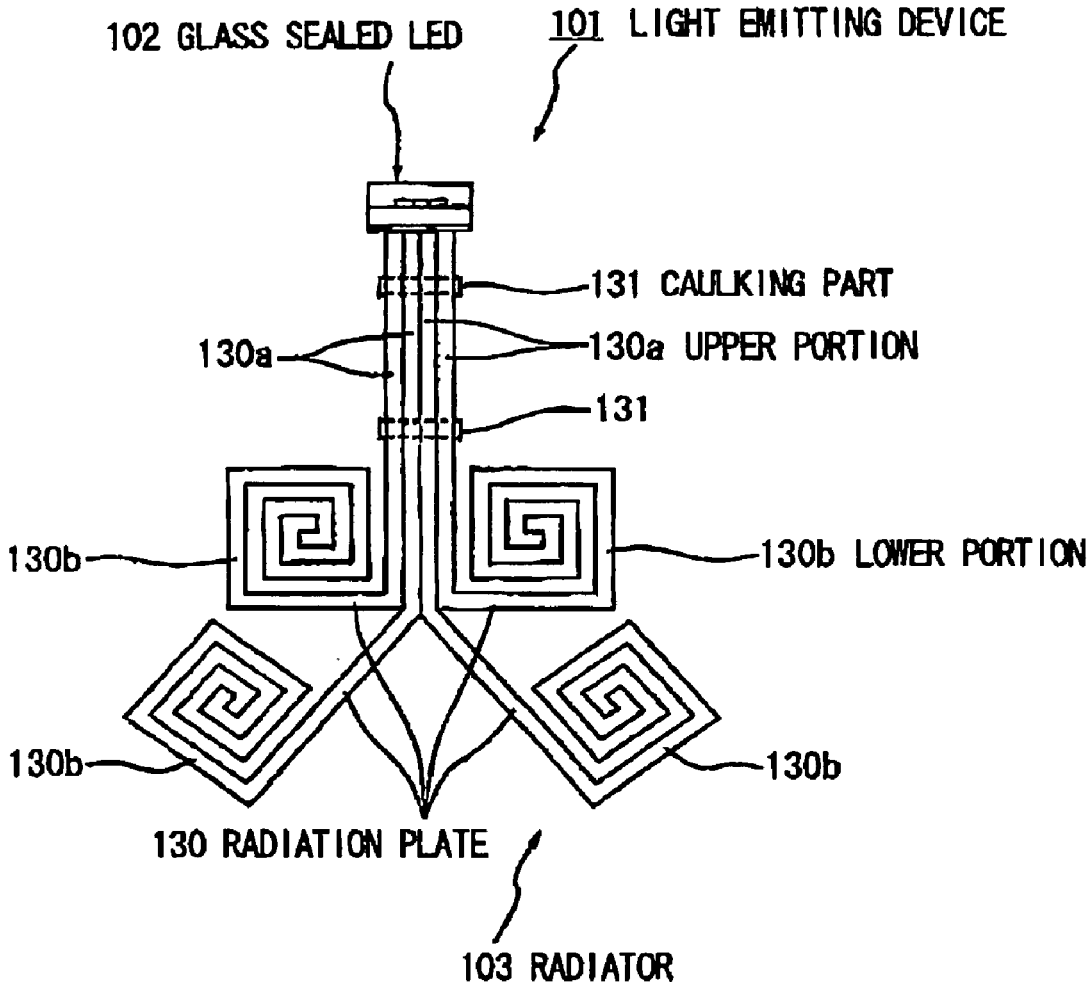
FIG. 13 is a front view showing a modification of the seventh embodiment.

And in the seventh preferred embodiment, a case that each of the radiation plates 130 is bent only at a boundary line between the upper portion 130*a* and the lower portion 130*b* has been explained, but for example as shown in FIG. 13, a top portion (the lower portion 130*b*) of each of the radiation plates 130 can be bent (folded) plural times. FIG. 13 shows a case that the lower portions 130*b* are folded eight times in a right angle respectively. By this a radiating area per a unit volume of each of the radiation plate 130 can be enlarged, and the light emitting device 101 can be further downsized. Further, each of the radiation plates 130 can be curved without being folded.

Figure 14:
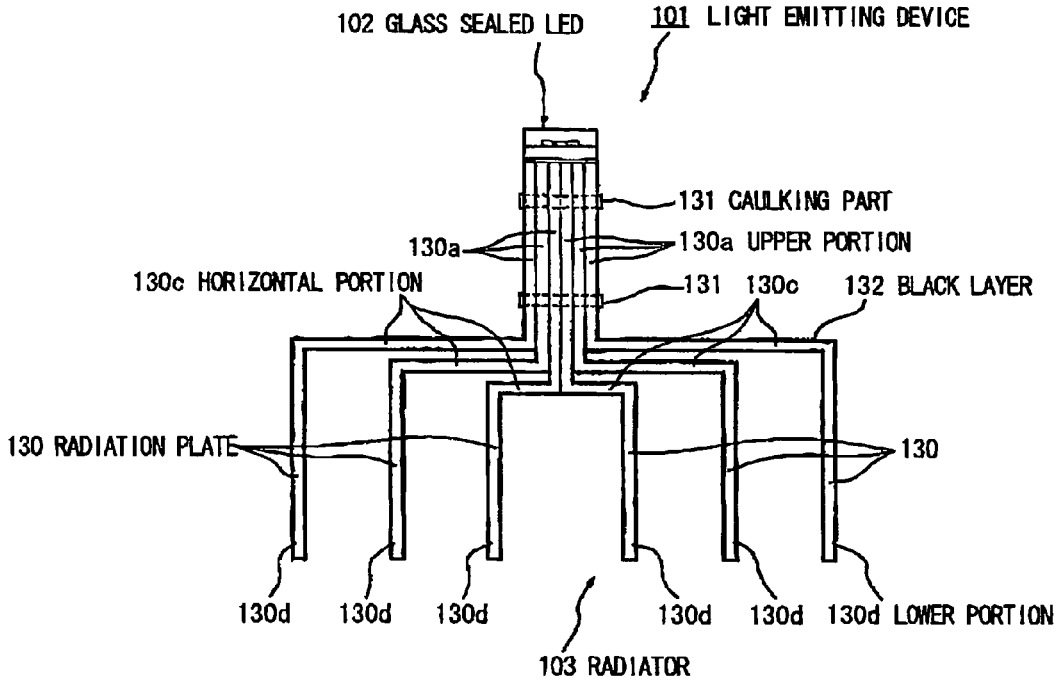
FIG. 14 is a front view showing another modification of the seventh embodiment.

Further, in the seventh preferred embodiment, a case that a top side of each of the radiation plates 130 (the lower portions 130*b*) extends aslant to the lower side and are disposed like the spokes of a wheel has been explained, but a shape of the top side of each of the radiation plates 130 is optional and as shown in FIG. 14, the each of the radiation plates 130 can comprise a horizontal portions 130*c* extending horizontally from a lower end of the upper portions 130*a* to left and right outsides and a lower portions 130*d* extending downward from left and right outer ends of the horizontal portions 130*c*. FIG. 14 shows a case that the lower portions 130*d* of the radiation plates 130 are disposed in parallel at a predetermined interval. And FIG. 14 shows a case that a black layer 132 is formed on an exposed surface of the each of the radiation plates 130. The black layer 132 is composed of a chromium plating or a resin. The radiator 103 comprises a black exposed portion, so that a radiation efficiency of the exposed portion can be enhanced.

Figure 15:
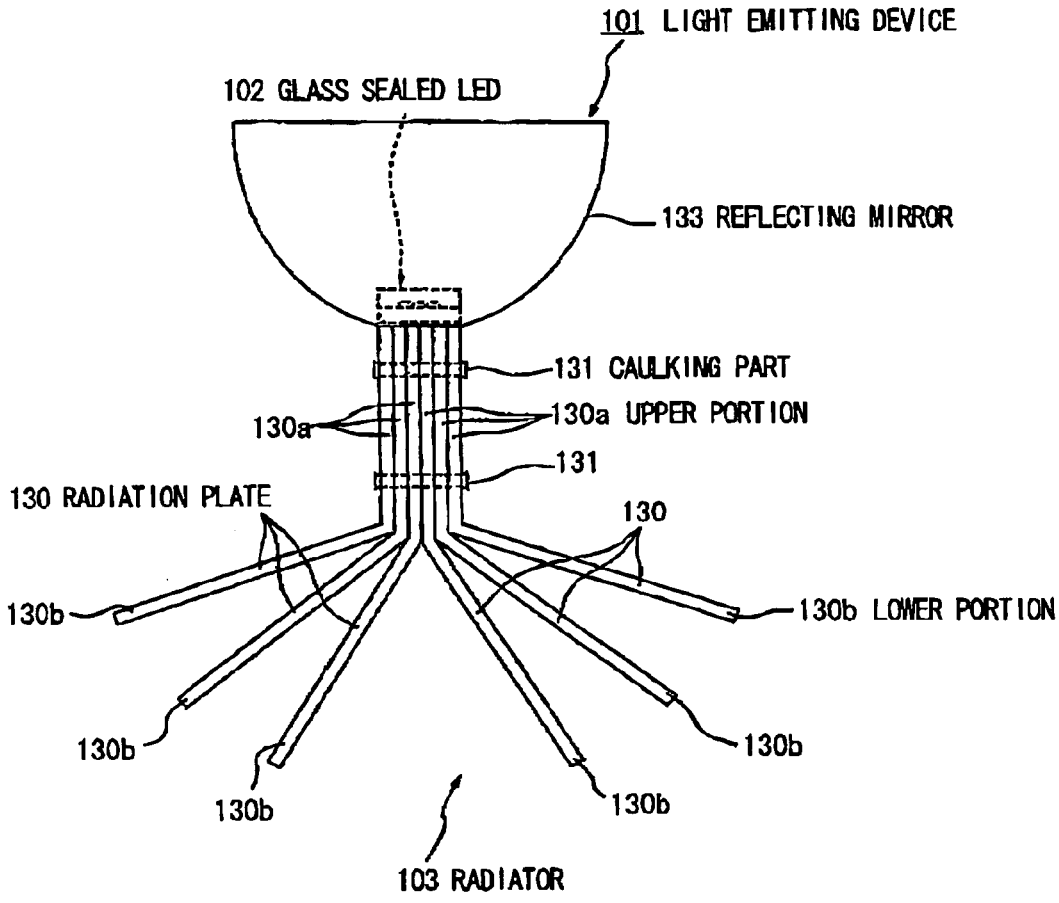
FIG. 15 is a front view showing another modification of the seventh embodiment.

Furthermore, as shown in FIG. 15, a reflecting mirror 133 as an optical system reflecting a light emitted from the glass sealed LED 102 in a direction of a center axis (an upper direction in FIG. 15) can be mounted. FIG. 15 shows a case that the reflecting mirror 133 is composed of ceramics, resins whose surfaces a metal is deposited on and is formed to a hemispheroidal shape covering a lower side and a lateral side. By this a light intensity of the center axis of the light emitting device 101 can be enhanced. Further, the reflecting mirror 133 can be formed by the radiation plate 130, so that a radiating area can be enlarged and the light intensity of the center axis can be enhanced without increasing a number of the components. And the optical system emitted from the glass sealed LED 102 is not limited to the reflecting mirror 133 for example a prism, a lens can be used.

Figure 16:
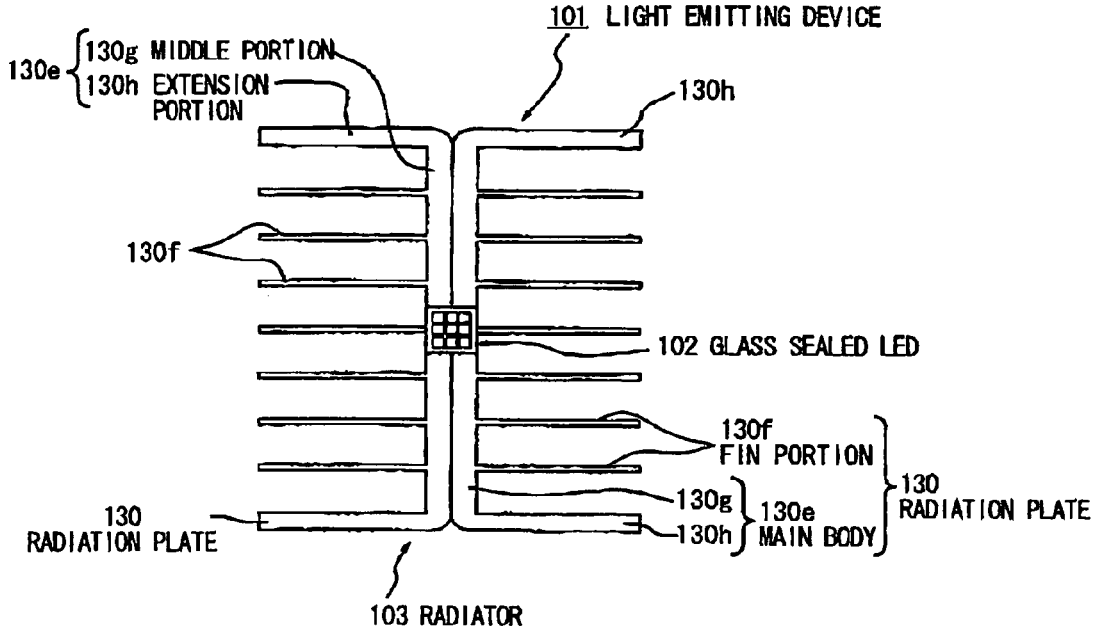
FIG. 16 is a front view showing another modification of the seventh embodiment.

And, in the seventh preferred embodiment, a case that each of the radiation plates 130 comprises a piece of plate has been explained, but for example as shown in FIG. 16, fin portions 130 f can be formed integrally with the each of the radiation plates 130 so as to form the radiator 103 comprising a plurality of heat conductive plate members combined as a part thereof is apart from each other. The radiator 103 of the light emitting device 101 shown in FIG. 16 comprises a pair of the radiation plate 130 comprising main bodies 130*e* of 0.3 mm thickness and fin portions 130*f* of 0.2 mm thickness formed integrally with the main bodies 130*e*.

Figure 17:
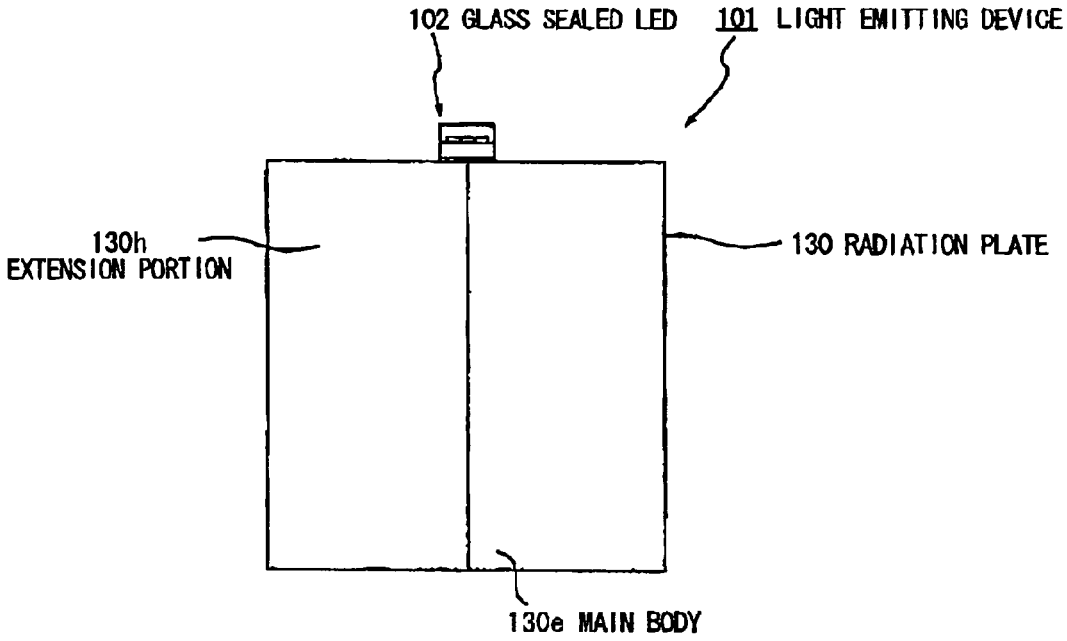
FIG. 17 is a front view showing another modification of the seventh embodiment.

The light emitting device 101 shown in FIG. 16 will be concretely explained. The main bodies 130*e* of the radiation plates 130 comprises a middle portion 130*g* whose plate surfaces face to left and right directions, and mounting the glass sealed LED 102 and extension portions 130*h* extending from front and back ends of the middle portion 130*g* to left and right outsides. The radiation plate 130 is formed by a lopping work. Each of the radiation plates 130 face-contacts with each other at left and right inner surfaces of the middle portions 130*g* and is connected and fixed through the Au—Sn joint, the caulking connection etc. As shown in FIG. 16, at least a part of each of the radiation plates 130 is apart from each other since the extension portions 130*h* extend in an opposite direction mutually. The glass sealed LED 102 is mounted on a center part in a front and back direction of upper surfaces of the middle portions 130*g*. In the main bodies 130*e* the fin portions 130*f* are juxtaposed at an interval of 0.2 mm in a front and back direction, and distances between the fin portions 130*f* disposed at the most front and the most back positions and the extension portions 130*h* are set to 2.0 mm. Each of the fin portions 130*f* is formed to a plate shape, and the fins 130*f* are composed of a plurality of plate members which are combined together so that at least a part thereof is disposed apart from each other. In the light emitting device 101 seven pieces of the fin portions 130*f* per a piece of the radiation plate 130 are set, and sizes of the fin portion 130*f* and the extension portion 130*h* in left and right directions are set identical to each other, so that as shown in FIG. 16, the radiation plate 130 comprises a comb structure as a whole at an upper surface viewing, and as shown in FIG. 17, at a front viewing only extension portions 130*h* disposed at a near side can be visible. According to the light emitting device 101 there is no connection part between the main body 130*e* and the fin portion 130*f*, so that at a heat transmittance a connection resistance is not generated. And a folding work is not needed for forming each of the fin portions 130*f*, so that the fin portion 130*f* can be easily formed and is suitable for a mass production. Therefore, a making cost can be decreased.

Figure 18:
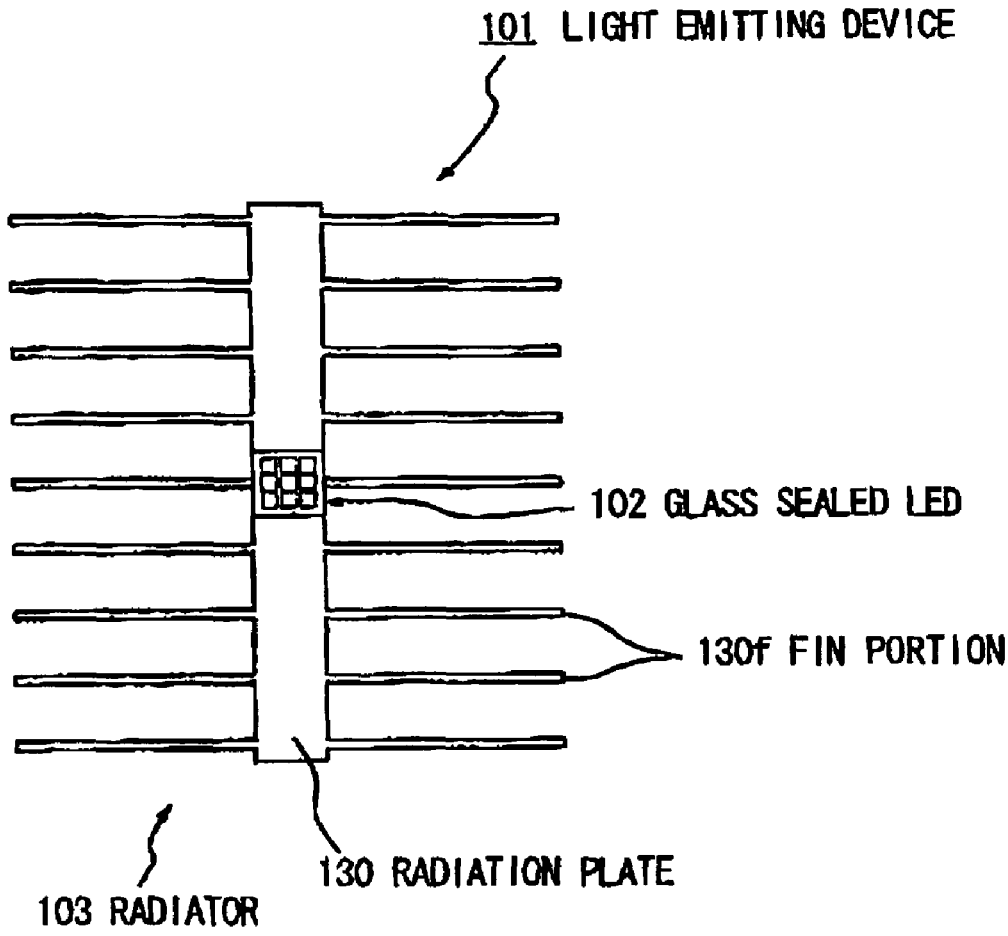
FIG. 18 is a front view showing another modification of the seventh embodiment.

Further, as shown in FIG. 18, the radiator 103 can be formed from one member. FIG. 18 shows a light emitting device 101 that the radiator 103 comprises a piece of the radiation plate 130 and a plurality of the fin portions 130*f* are formed on both of left and right surfaces of each of the radiation plates 130 at an even interval in front and back directions.

Eighth Embodiment

Composition of Light Emitting Device

Figure 19:
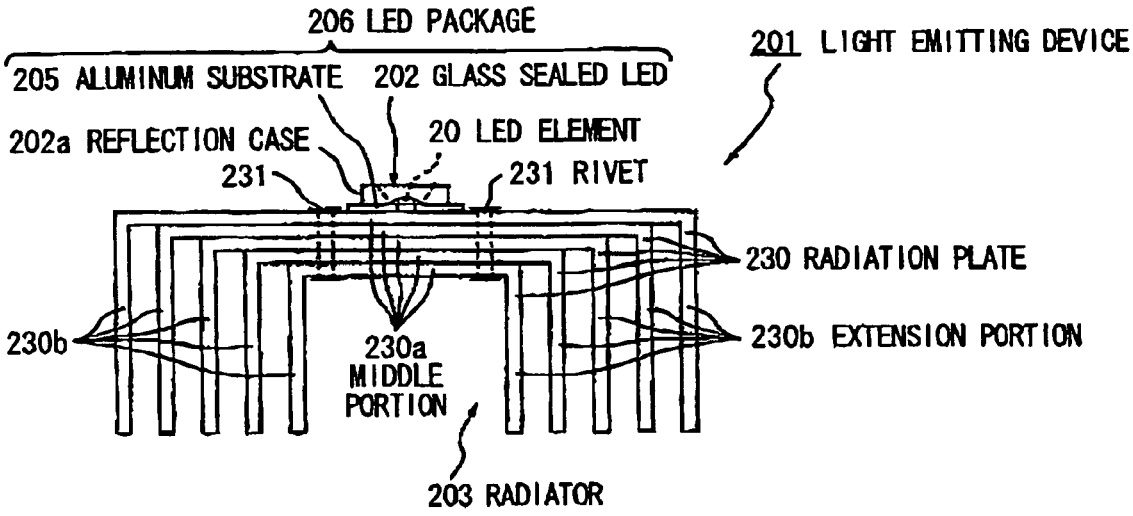
FIG. 19 is a side view showing a light emitting device in an eighth preferred embodiment according to the invention.

As shown in FIG. 19, the light emitting device 201 comprises a glass sealed LED 202 formed by sealing a plurality of LED elements 20 with a glass as a light source, and an aluminum substrate mounting the glass sealed LED 202, and a radiator 203 mounting the aluminum substrate. The radiator 203 comprises a plurality of the radiation plates 230 which are composed of a high thermally-conductive plate material and integrated by rivets 231. That is, the radiator 203 comprises a plurality of the radiation plates 230 which are connected together so that at least a part thereof is disposed apart from each other.

As shown in FIG. 19, the glass sealed LED 202 is mounted in a condition that a LED element 20 is sealed by a glass in a reflection case 202*a* composed of a ceramic material such as alumina. On an under surface of the reflection case 202*a* an outer terminal is formed and electrically connected to an aluminum substrate 205. The glass sealed LED 202 and the aluminum substrate 205 compose a LED package 206.

The radiator 203 comprises a plurality of the radiation plates 230 composed of a copper and comprising 0.3 mm thickness. Each of the radiation plates 230 comprises middle portions 230*a* whose plate surfaces face to a vertical direction, and a pair of extension portions 230*b* extending from left and right ends of the middle portion 230*a* downward, whose plate surfaces face to left and right directions. Each of the radiation plates 230 is laminated at the middle portion 230*a* and is caulked by a plurality of the rivets 231. The rivets 231 can be composed of a metal or a resin, above all a high thermally-conductive material such as a copper, a brass is preferable. Each of the radiation plates 230 is preliminarily formed by a press bent process to a U-shape as a cross-sectional shape and as shown in FIG. 19, and dimensions thereof are set, so that the extension portions 230*b* of the radiation plate 230 are disposed at an even interval. In the embodiment the LED package 206 is fixed on the middle portion 230*a* of the radiation plate 230 disposed at most upper portion.

Figure 20:
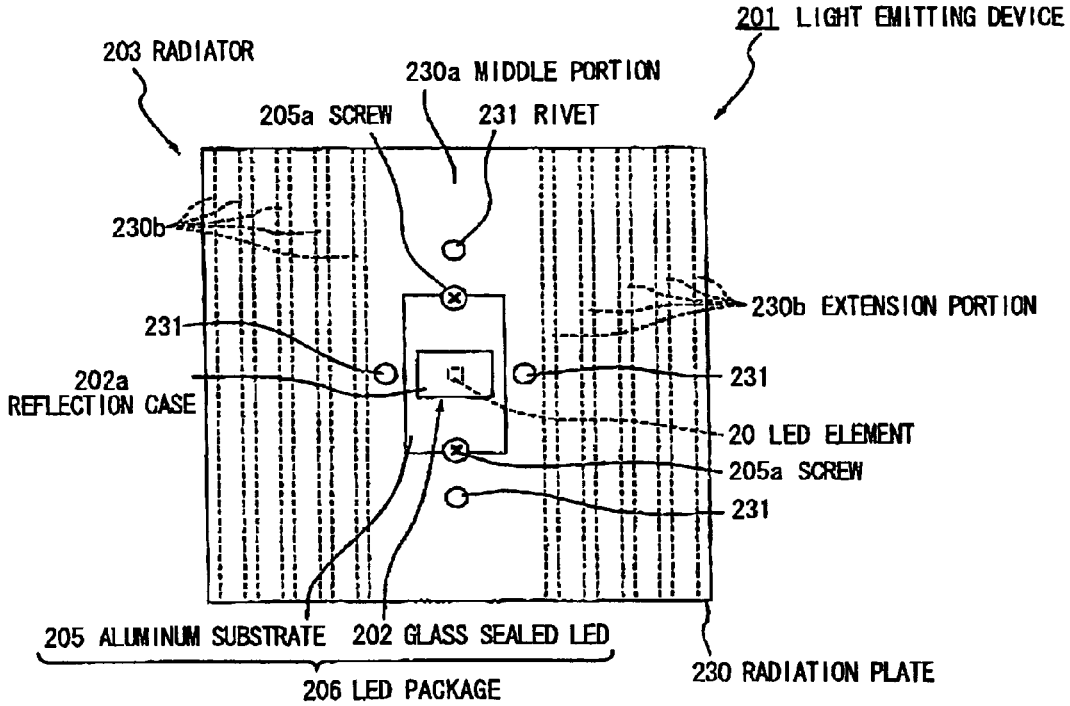
FIG. 20 is a top view showing the light emitting device in FIG. 19.

As shown in FIG. 20, the aluminum substrate 205 is fixed on the middle portion 230*a* of the radiation plate 230 located at the highest position by screws 205*a*. Material of the screws 205*a* is optional, but for example a high thermally-conductive material such as a copper, a brass is preferable. The aluminum substrate 205 and a top surface of the radiation plate 230 face-contact with each other.

Advantages of the Eighth Embodiment

According to an eighth preferred embodiment of the invention, the following advantages are achieved.

(1) The LED package 206 is joined to the radiator 203, so that a glass sealed LED 202 not comprising the radiation pattern in a back surface side of the LED element 20 can also radiate a heat to the radiator 203 through the aluminum substrate 205. In the embodiment the reflection case 202*a* of the glass sealed LED 202 is composed of an alumina comprising a relatively high thermal-conductivity and the glass sealed LED 202 is mounted on the aluminum substrate 205 comprising a relatively high thermal-conductivity, so that a heat generated at the LED element 20 can be smoothly conducted to the radiation plate 230. Further, the aluminum substrate 205 and the radiation plate 230 face-contact with each other, so that a wide heat conducting path can be acquired.

(2) Radiation plates 230 composed of copper plates comprising a high thermal-conductivity are integrated by the rivets 231 and a thicker part is formed by laminating the thin plates, so that a productivity of the radiator 203 formed to a fin shape and increasing a thickness of a middle side than both end sides can be enhanced. And, an increase and decrease of a number of the radiation plates 230 and a change of a radiation shape in response to a desired radiation characteristic are easily performed, so that the radiator 203 comprising an appropriate radiation performance corresponding to a used number of the LED element 20 and an amount of heat generation can be realized. Further, the LED package 206 to be a heat source is disposed on the middle portion 230*a* of the each of the radiation plates 230, so that the heat emitted from the LED element 20 can be directly conducted to each of the radiation plates 230. Therefore, without relation to a difference of a thermal conductivity among the radiation plates 130, a high radiation performance equal to a bulk-like heat sink comprising a branched front edge can be realized by an extremely simple method.

(3) The extension portions 230*b* of each of the radiation plates 230 are formed to be apart from each other, so that a surface area of the radiator 203 can be enlarged and a heat can be efficiently diffused from the radiator 203 while the radiator 203 can be reduced in size and weight. Further, a novel and original appearance of the light emitting device 201 can be provided.

(4) The glass sealed LED 202 is used for a light source part, so that even if a temperature rise is not kept to a degree of several 10° C., an electrical breaking by a stress due to a temperature change as a sealing by a sealing resin comprising a relatively large coefficient of thermal expansion can not be caused, and a reduction of light volume due to a lowering of transparency of the sealing materials can not be caused. Therefore, even if a radiation performance of the radiator 203 is identical, a case of using the glass sealing can realize a high output by using a lager electric power than a case of using the resin sealing.

Figure 21:
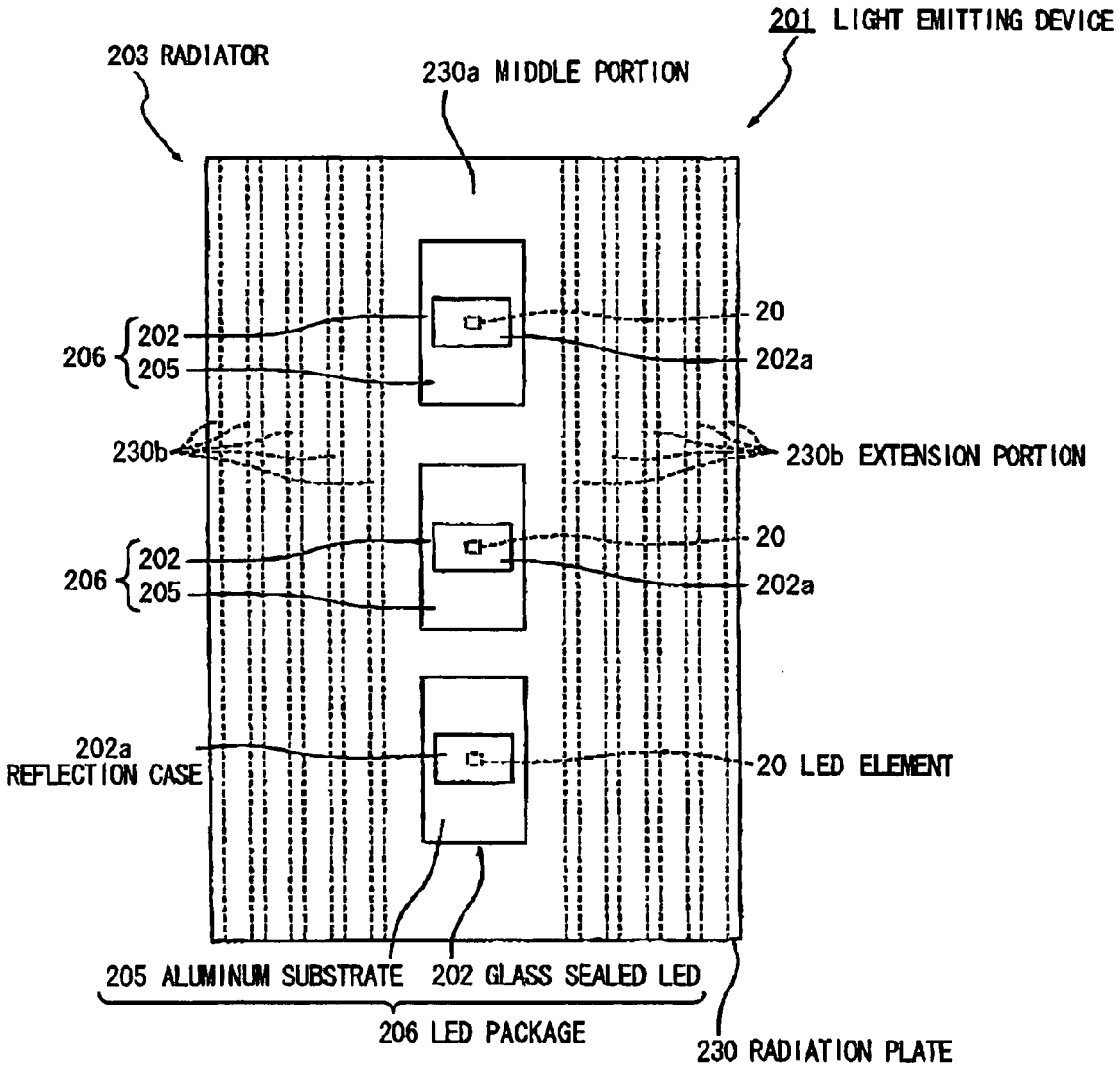
FIG. 21 is a top view showing a modification of the eighth embodiment.

Further, in the eighth preferred embodiment of the invention, a case that a piece of LED package 206 per a piece of the radiator 203 is mounted has been explained, but for example as shown in FIG. 21, a plurality of the LED packages 206 per a piece of the radiator 203 can be mounted. FIG. 21 shows a light emitting device 201 that three pieces of the LED package are tandemly-disposed on the radiation plate 230 disposed at the most highest position. In the light emitting device 201 each of the LED packages 206 is joined to the radiation plate 230 by a soldering, not by a screw cramping. Further, each of the radiation plates 230 is joined to each other though an Au—Sn plating, not by a riveting. That is, as shown in FIG. 21, in the light emitting device 201 a fastening tool etc. is not used, so that the light emitting device 201 comprises a neat appearance and can be made by a reflow process.

And in the eighth preferred embodiment of the invention, the LED package 206 comprising the LED element 20 disposed in the reflection case 202*a* has been explained, but a configuration of the LED package 206 can be changed appropriately.

Ninth Embodiment

Composition of Light Emitting Device

Figure 22A:
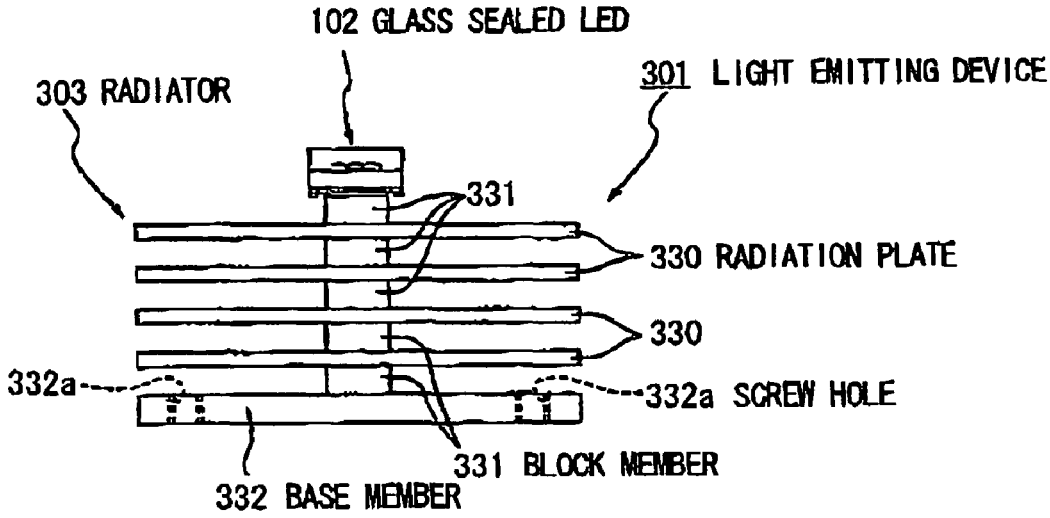
FIG. 22A is a side view showing a light emitting device in a ninth preferred embodiment according to the invention.
Figure 22B:
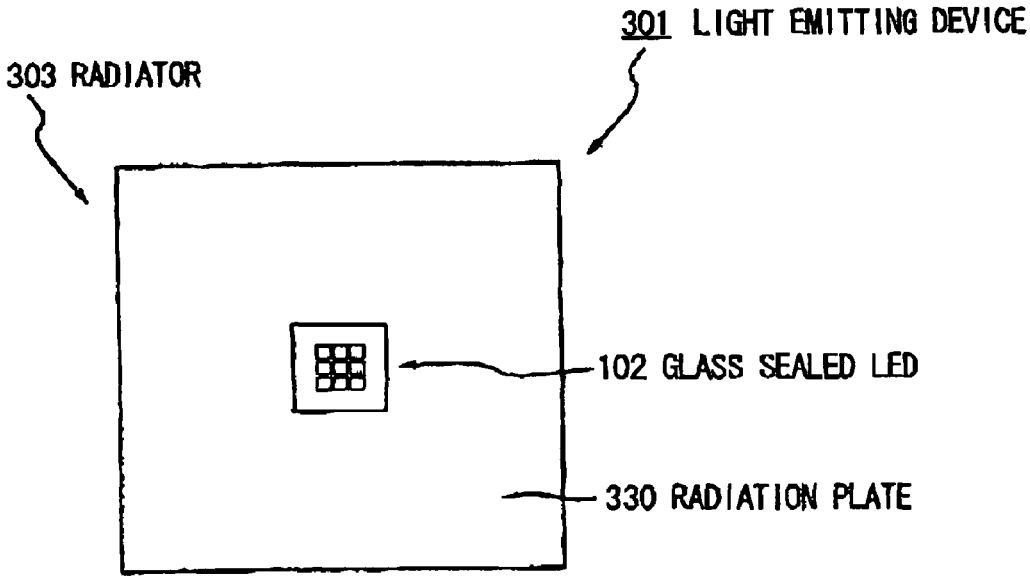
FIG. 22B is a top view showing the light emitting device in FIG. 22A.

As shown in FIG. 22, the light emitting device 301 comprises the glass sealed LED 102 formed by sealing a plurality of LED elements 20 with a glass as a light source, and a radiator 303 connected to the radiation pattern 113 of the glass sealed LED 102. The radiator 303 comprises block members 331 formed to an identical shape in a horizontal section to the shape of the radiation pattern 113 of the glass sealed LED 102, tabular radiation plates 330 whose plate surfaces face to a vertical direction, and a base member 332 mounted on a metal plate etc. (not shown). That is, the radiator 303 comprises a plurality of the radiation plates 330 composed of a thermally-conductive material which are connected together so that a whole part thereof is disposed apart from each other.

The radiator 303 comprises a plurality of the block members 331 and a plurality of the tabular radiation plates 330 which are alternately stacked. And the block member 331 disposed at the most lowest position is joined to the base member 332. Each of the block members 331 is composed of a copper and is disposed so as to overlap with the radiation pattern 113 of the glass sealed LED 102 in an upper surface viewing. Each of the block members 331 comprises a vertical size of 2.0 mm. Each of the radiation plates 330 is interposed between the block members 331 as a thermal conducting part, but as a whole each of the block members 331 is formed to a piece of column extending from an lower portion of the radiation pattern 113 to the base member 332. Each of the block members 331 is interposed between the glass sealed LED 102 and each of the radiation plates 330 and transmits a heat of the glass sealed LED 102 to each of the radiation plates 330. Each of the radiation plates 330 is composed of a copper and is formed to a square shape larger than the glass sealed LED 102 in an upper surface viewing. A vertical size of each of the radiation plates 330 is 0.3 mm. Each of the radiation plates 330 is interposed between each of the block members 331 at a middle portion in an upper surface viewing, and is fixed to each other. That is, as shown in FIG. 22A, each of the radiation plates 330 is apart from each other by just a vertical size of each of the block members 331.

The base member 332 is composed of a copper and comprises an identical shape in an upper surface view to the shape of each of the radiation plates 330. A vertical size of the base member 332 is 1.0 mm. The base member 332 comprises screw holes 332*a* for mounting the member 332 on a metal plate etc. (not shown). The radiation pattern 113 of the glass sealed LED 102, each of the block members 331, each of the radiation plates 330, and the base member 332 are connected to each other through the Au—Sn joint in a nitrogen atmosphere at 300 to 350° C. and after the connection a surface-coating for a rust-proofing.

Advantages of the Ninth Embodiment

According to a ninth preferred embodiment of the invention, the following advantages are achieved.

(1) The glass sealed LED 102 comprises a structure that a plurality of the LED elements 20 are mounted, so that an interaction of a heat in the elements can be decreased in comparison with a structure that a LED element of a large size are mounted, and a heat resistance can be reduced. That is, the LED element of a large size are identified with a structure that a plurality of LED elements contacts with each other, so that even if an amount of radiation to the element mounting substrate 121 per an element area is even, the structure that a plurality of the LED elements is disposed at a certain interval can keep a temperature elevation of the LED elements 20 lower. In addition to the above, the glass sealing material 102 comprising a small coefficient of thermal expansion and not generating a tensile tension to the LED elements 20 due to an expansion of the sealing material even in a high temperature is used, so that the LED element 20 comprising a small mounting strength can be used. And a p-side electrode of each of the LED elements 20 comprises an ITO electrode and a relatively small p-side pad electrode formed on the ITO electrode, and the LED element 20 is mounted by total two pieces of bumps composed of a piece of anode and a piece of cathode, so that the LED element 20 comprises a light emitting efficiency higher than conventional elements mounted by three pieces or more of bumps.

(2) A heat is drawn through the radiation pattern 113 constituting a bottom of the glass sealed LED 102, so that an interaction of a heat between the LED elements 20 can be decreased, and also by this a heat resistance can be reduced. In particular, a thickness of the element mounting substrate 121 is set thinner than a mounting interval of the LED element 20, so that a heat generated in the LED elements 20 is conducted to a direction of the radiation pattern 113 more than to a direction of neighboring LED elements 20. Therefore, also by this a light emitting efficiency can be enhanced.

(3) The glass sealed LED 102 is mounted through the Au—Sn joint with a relatively high thermal conductivity, so that diffusion efficiency to the radiator 303 becomes higher in comparison with a plating process. And the glass sealed LED 102*a* is heated up to 300 to 350° C. in the Au—Sn mounting, but a glass sealing material 122 is not changed in quality since the temperature is within an allowable temperature limit of the glass sealing material 122. Further, the glass sealing material 122 is not changed in quality when the temperature is below a glass transition temperature (Tg point). Therefore, when the mounting can be performed at a temperature below the glass transition temperature, even if materials other than the Au—Sn are used, a similar effect can be obtained. As described above, a mounting at 200° C. or more can be realized which can not be achieved by a conventional mounting using resins such as a silicone resin, an epoxy resin.

(4) The block member 331, which has a thermal conductivity higher than the radiation pattern 113 and has the same shape as the radiation pattern 113 when viewed from the top, is connected to the radiation pattern 113 of the glass sealed LED 102. Therefore, a heat value to be conducted to the radiation pattern 113 can be sufficiently received by the block member 331. Further, since the plural block members 331 are arrayed in series in the heat flow direction from the radiation pattern 113, heat can be smoothly conducted from the top to the bottom block members 331. Further, since the radiation plates 330 of copper like the block member 331 are interposed between the block members 331, heat can be radiated through and dissipated from the radiation plates 330. In this embodiment, the surface of the radiation plate 330 is exposed except the contact area with the block member 331. Thus, the radiation area can be rendered larger. Further, since the exposed part of the radiation plate 330 is coated with a corrosion-resistant agent, the heat radiation efficiency can be enhanced as compared to the case that the copper material is exposed.

(5) The block members 331 form one column as a whole. Therefore, the radiator 303 can be reinforced in structure. Thus, no local internal stress occurs between due to external force, heat etc., and sufficient strength and reliability can be secured.

(6) The radiation plates 330 formed of a copper material with a high thermal conductivity are alternately stacked on the block members 331. Thus, according to the radiation characteristic of the glass sealed LED 102, the number of the radiation plates 330 can be easy changed. Namely, the radiator 303 can be designed that has a suitable radiation property according to the number of the LED element 20 used or its heat value. Especially, when the gap between the radiation plates 330 is set to be 1 to 4 mm, radiation property in natural convection without forced air cooling, low cost and compactness can be obtained. In experiments by the inventors, where the number of the radiation plates 330 and gaps therebetween are changed to have a same radiation property, the most compact size can be obtained by setting the gap to be 1 to 2 mm. Thus, when the height of the block member 331 is 2 mm and the gap between the radiation plates 330 is 2 mm, the radiation property, cost and compactness can be optimized.

(7) By separating the radiation plates 330 from each other, the surface area of the radiator 303 can be increased. Thus, heat from the radiator 303 can be efficiently radiated, and the radiator 303 can be downsized and lightened. Especially, high-output LED elements 20 can be arrayed at narrow intervals and a large-size heat sink can be unnecessary. These are very advantageous in practical use. Further, the light emitting device 301 can be provided with a novel appearance. When using the forced air cooling, the compactness can be further improved such that the gap between the radiation plates 330 can be rendered 1 mm or less.

(8) Since the base member 332 is provided with the screw holes 332*a*, the light emitting device 301 can be easy secured. Further, since the fixing members are located at the based member 332 farthest from the glass sealed LED 202 as the source of heat generation, thermal load applied to the fixing members can be reduced.

Figure 23A:
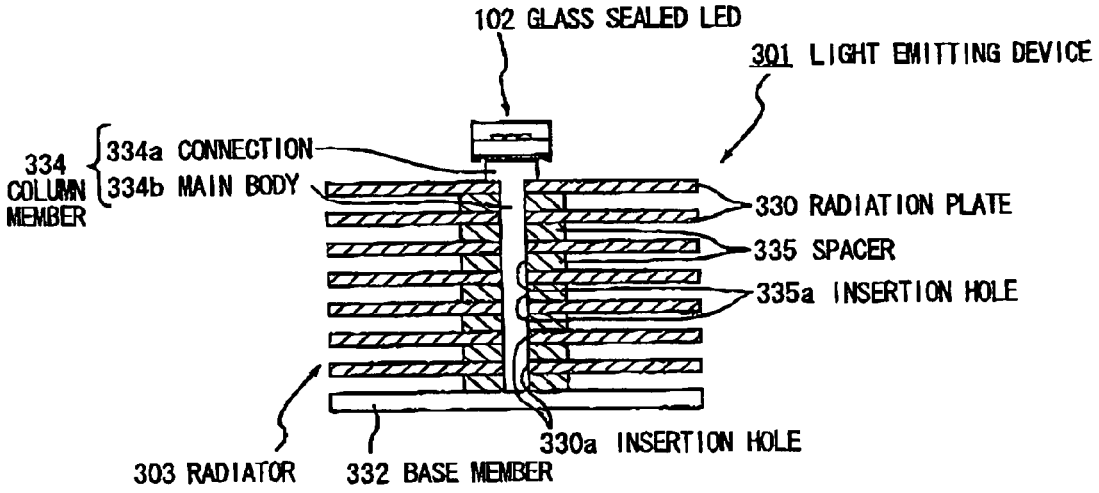
FIG. 23A is a cross sectional view showing a modification of the ninth preferred embodiment.
Figure 23B:
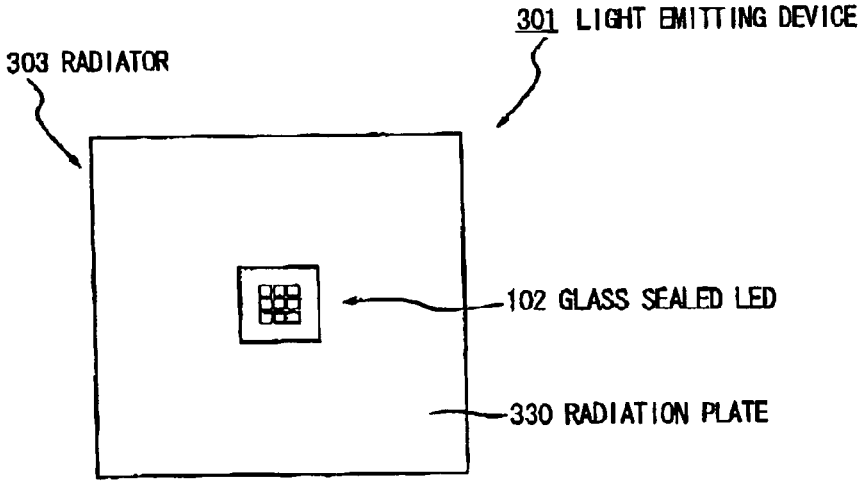
FIG. 23B is a top view showing the modification in FIG. 23A.

Although in the ninth embodiment the block member 331 and the radiation plate 330 are stacked alternately, a column member 334 penetrating the parallel-arrayed radiation plates 330 may be used instead of the block member 331 as shown in FIG. 23A. The column member 334 is formed of copper and column-shaped by cutting out the same material as the block member 331. The radiation plates 330 are each provided with an insertion hole 330*a* pinto which the column member 334 is inserted and which is circular when viewed from the top. Further, a spacer 335 of copper is interposed between the radiation plates 330. The spacer is also provided with an insertion hole 335*a* into which the column member 334 is inserted. A connection 334*a* is formed on the top part of the column member 334 such that it is connected to the radiation pattern 113 of the glass sealed LED 102. The connection 334*a* has a diameter greater than a main body 334*b* of the column member 334, and is in contact with the top surface of the top radiation plate 330. The lower end of the main body 334*b* is connected to the base member 332 such that the spacers 335 and the radiation plates 330 are sandwiched between the connection 334*a* and the base member 332. In FIG. 23A, each part of the light emitting device 301 is connected through an Ag brazing joint, and is, after the brazing, subjected to corrosion-resistant coating, and the glass sealed LED 102 is mounted through the Au—Sn joint. The column member 334 does not have any joint with the plural members, and is not subjected to influence of heat resistance of the joint portion, and can conduct heat from the glass sealed LED 102 to the bottom direction as shown in FIG. 23A. The column member 334 is formed of copper with a high thermal conductivity so that the entire column member 334 is kept at nearly equal temperature and heat can be efficiently conducted from there to the radiation plates 330.

Figure 24A:
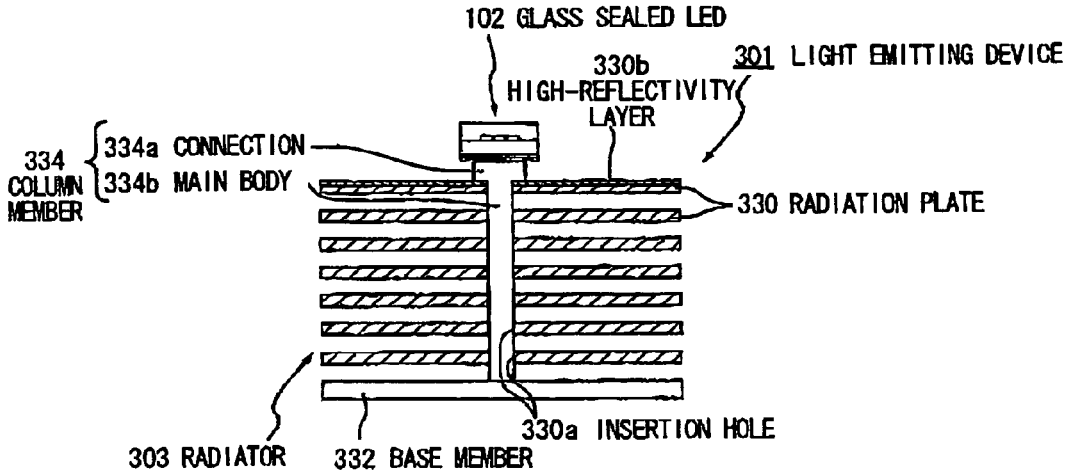
FIG. 24A is a cross sectional view showing another modification of the ninth preferred embodiment.
Figure 24B:
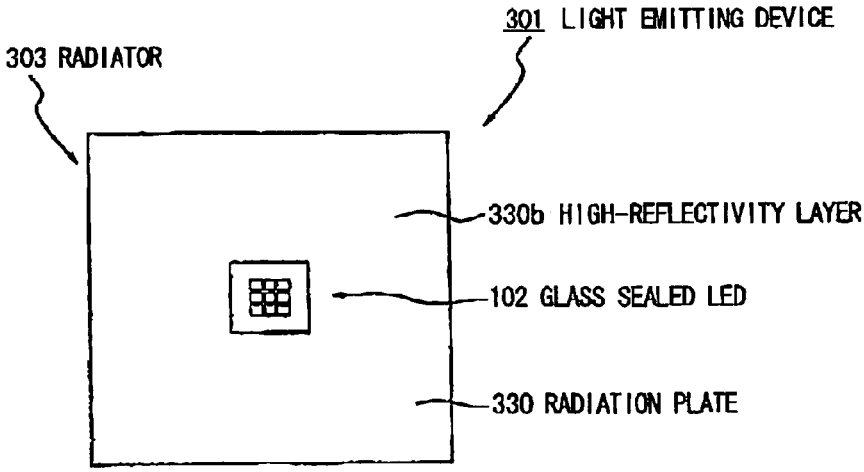
FIG. 24B is a top view showing the modification in FIG. 24A.

Alternately, as shown in FIGS. 24A and 24B, a high reflectivity layer 330*b* may be formed on the top radiation plate 330. The high-reflectivity layer 330*b* can be a white coating material coated on the surface of the radiation plate 330, or a high-reflectivity silver metal deposited on the surface. Thus, by reflecting light radiated downward from the glass sealed LED 102 by the radiator 303 (i.e., the top radiation plate 330) with an increased reflectivity, the light extraction efficiency can be increased. In the light emitting device 301, the radiation plates 330 are bonded to the column member 334 while retaining the radiation plates 330 by a jig etc. to be separated from each other, and after the bonding the jig is removed.

Figure 25A:
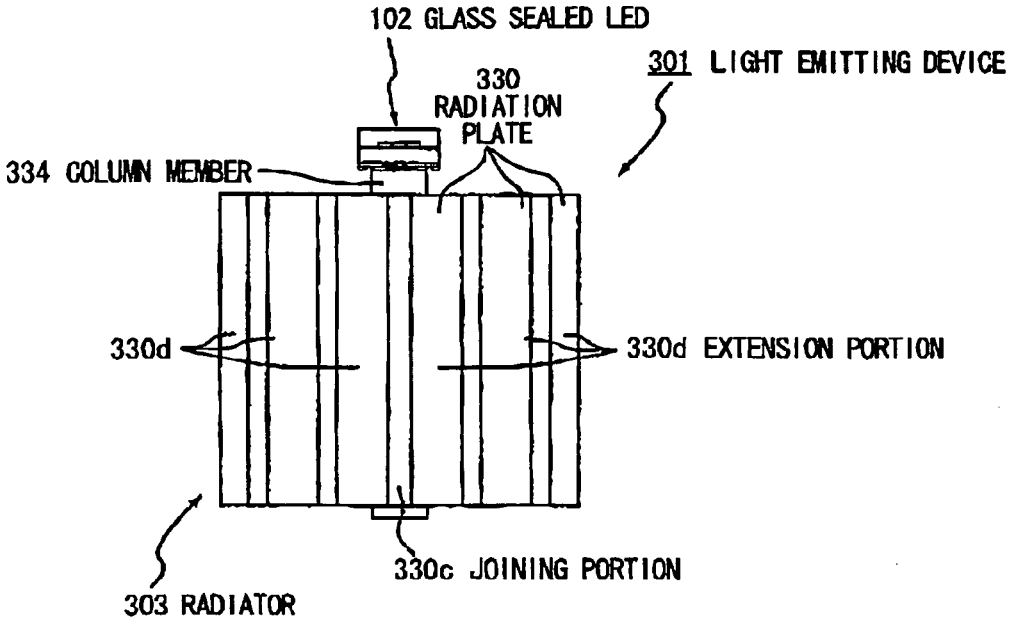
FIG. 25A is a side view showing another modification of the ninth preferred embodiment.
Figure 25B:
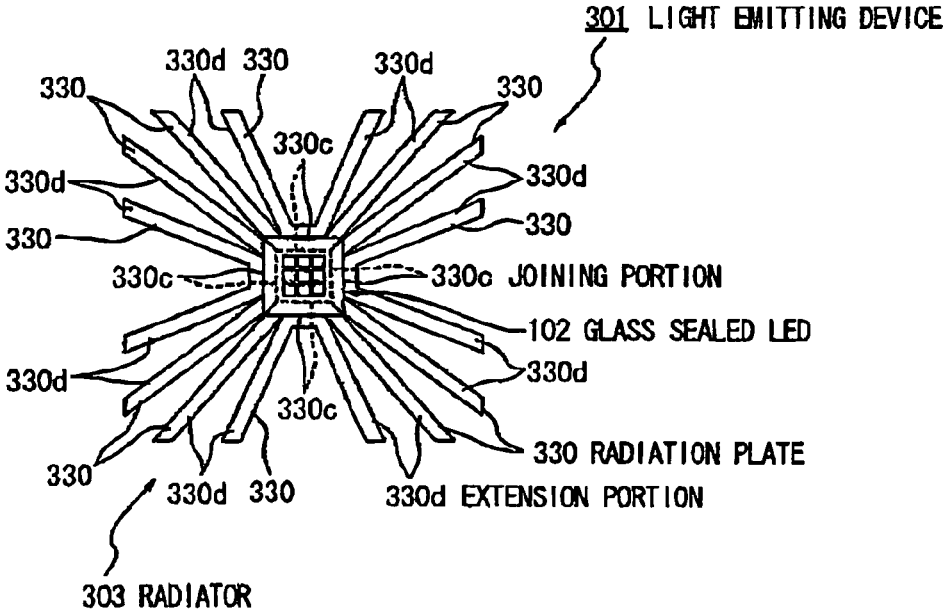
FIG. 25B is a top view showing the modification in FIG. 25A.

Although in the ninth embodiment the planar radiation plates 330 are horizontally disposed, they may be vertically disposed as shown in FIG. 25A. As shown in FIGS. 25A and 25B, the column member 334 is shaped like a rectangular column, and plural radiation plates 330 are bonded through the Au—Sn joint to the side of the column member 334. As shown in FIG. 25B, the radiation plates 330 each comprise a joining portion 330*c* shaped along the side of the column member 334, and an extension portion 330*d* extended in the radial direction from the end of the joining portion 330*c*. The light emitting device 301 is constructed such that two of the radiation plates 330 are stacked, at the joining portions 330*c* thereof, on each of the four sides of the column member 334. As shown in FIG. 25Am the column member 334 is formed protruding down from the bottom of the radiation plates 330 when viewed from the side.

Although in the ninth embodiment the radiation plates 330 are disposed vertically, the disposition direction of the radiation plates 330 are optional. For example, as shown in FIGS.

Figure 26:
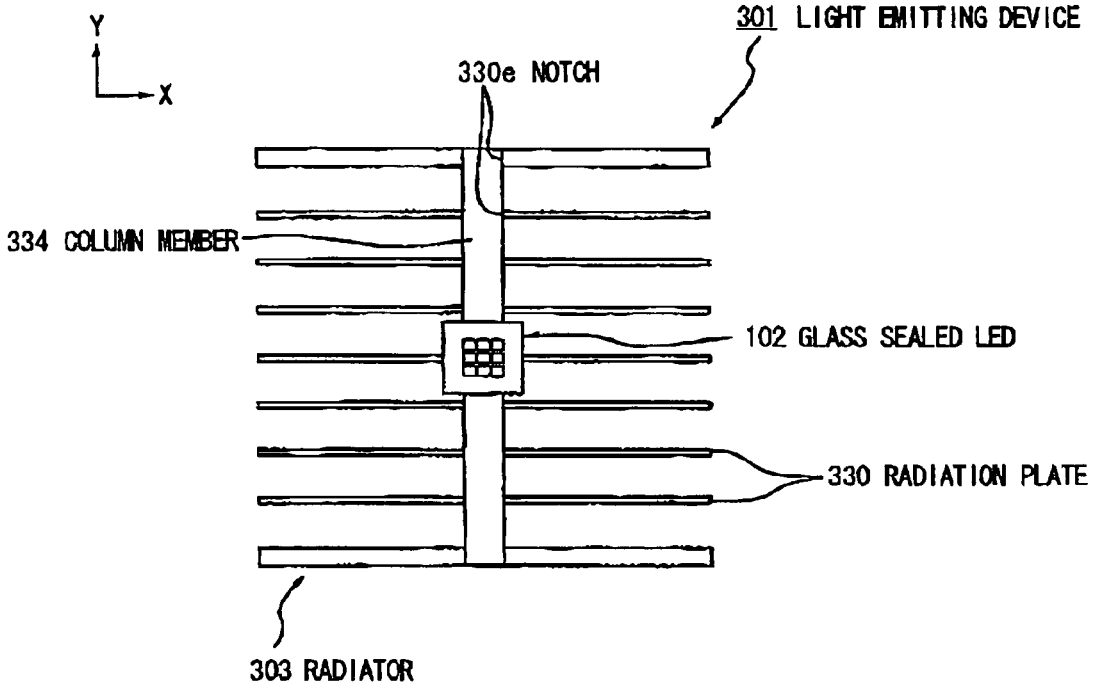
FIG. 26 is a top view showing another modification of the ninth preferred embodiment.
Figure 27:
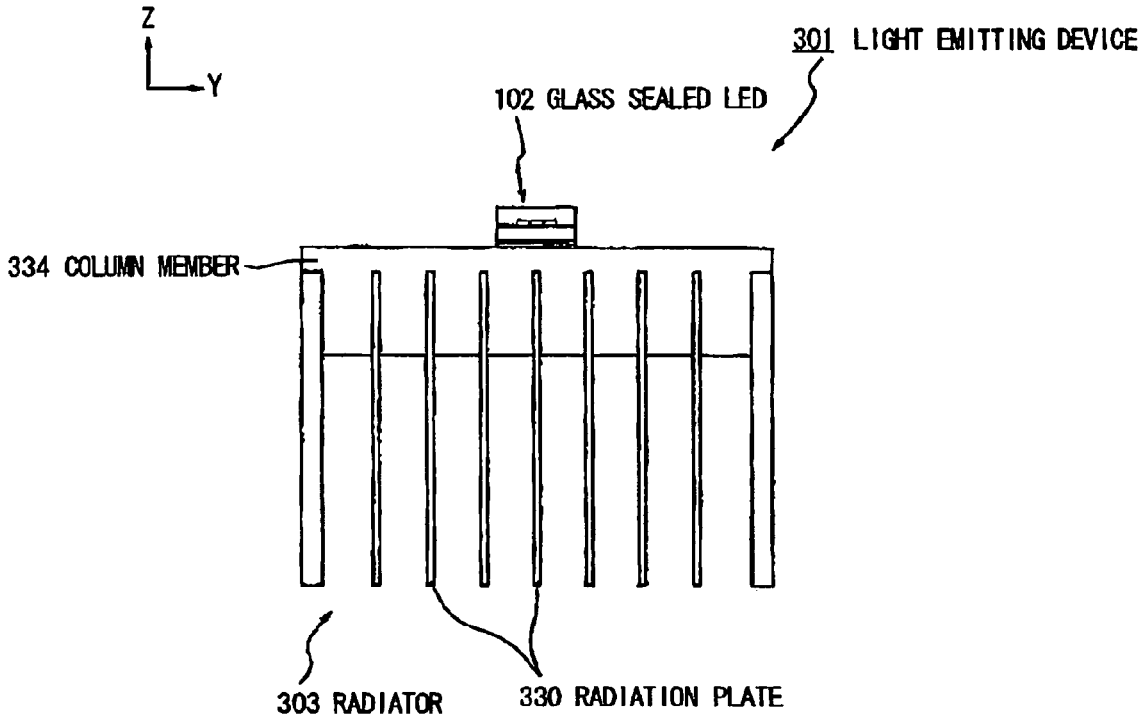
FIG. 27 is a side view showing another modification of the ninth preferred embodiment.
Figure 28:
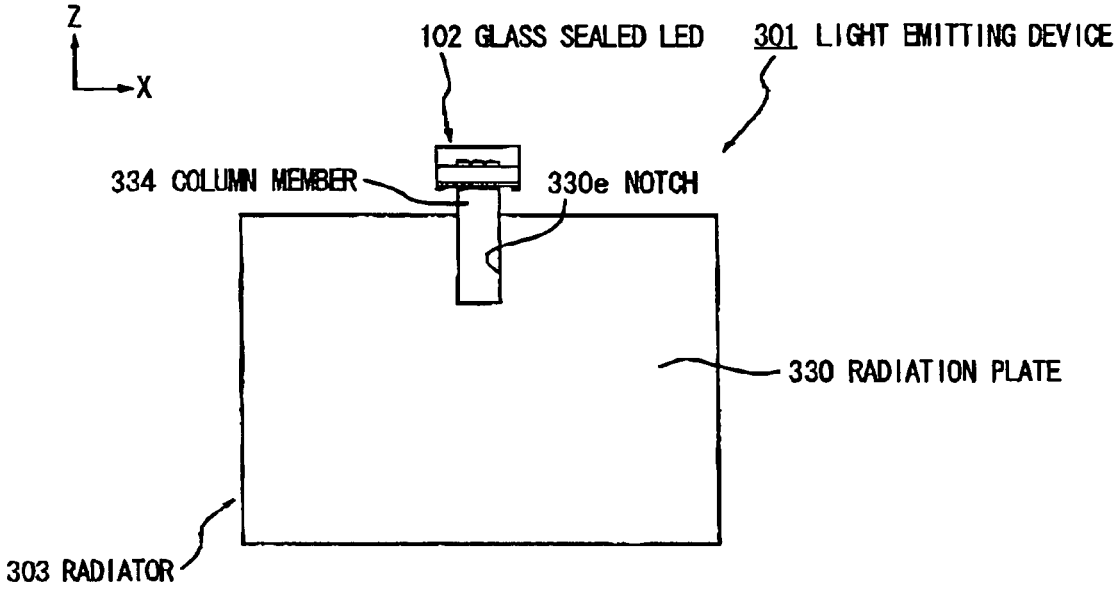
FIG. 28 is a front view showing another modification of the ninth preferred embodiment.

26 to 28, the radiation plates 330 may be arrayed in parallel in Y direction. In FIGS. 26 to 28, X, Y and Z directions correspond to right-left, front-back and up-down directions. As shown in FIG. 26, the radiation plates 330 of copper are connected on its top side to the column member 334 extended in the Y direction. Of the radiation plates 330, ones at both ends in the Y direction are 0.3 mm in thickness, ones between both ends in the Y direction are 0.1 mm in thickness, and they are disposed in parallel at intervals of 0.2 mm in the Y direction. The column member 334 is formed of copper and, as shown in FIG. 27, the glass sealed LED 102 is mounted, at the middle in the Y direction, on the column member 334. As shown in FIG. 28, the column member 334 is formed rectangular, 2 mm in width and 6 mm in length, when viewed from the front side. The radiation plates 330 are each provided with a notch 330*e* at its top middle part to receive the column member 334. The radiation plates 330 are bonded through Ag brazing joint to the column member 334. In case of the light emitting device 301, after the radiation plates 330 are bonded through the Ag brazing joint to the column member 334 while being heated at temperature of higher than 800° C., the glass sealed LED 102 is mounted on the column member 334. In the light emitting device 301, even when the radiation plates 330 are disposed downward or upward in the Z direction, they can dissipate the heat air to the outside in natural convection.

Tenth Embodiment

Composition of Light Emitting Device

Figure 29:
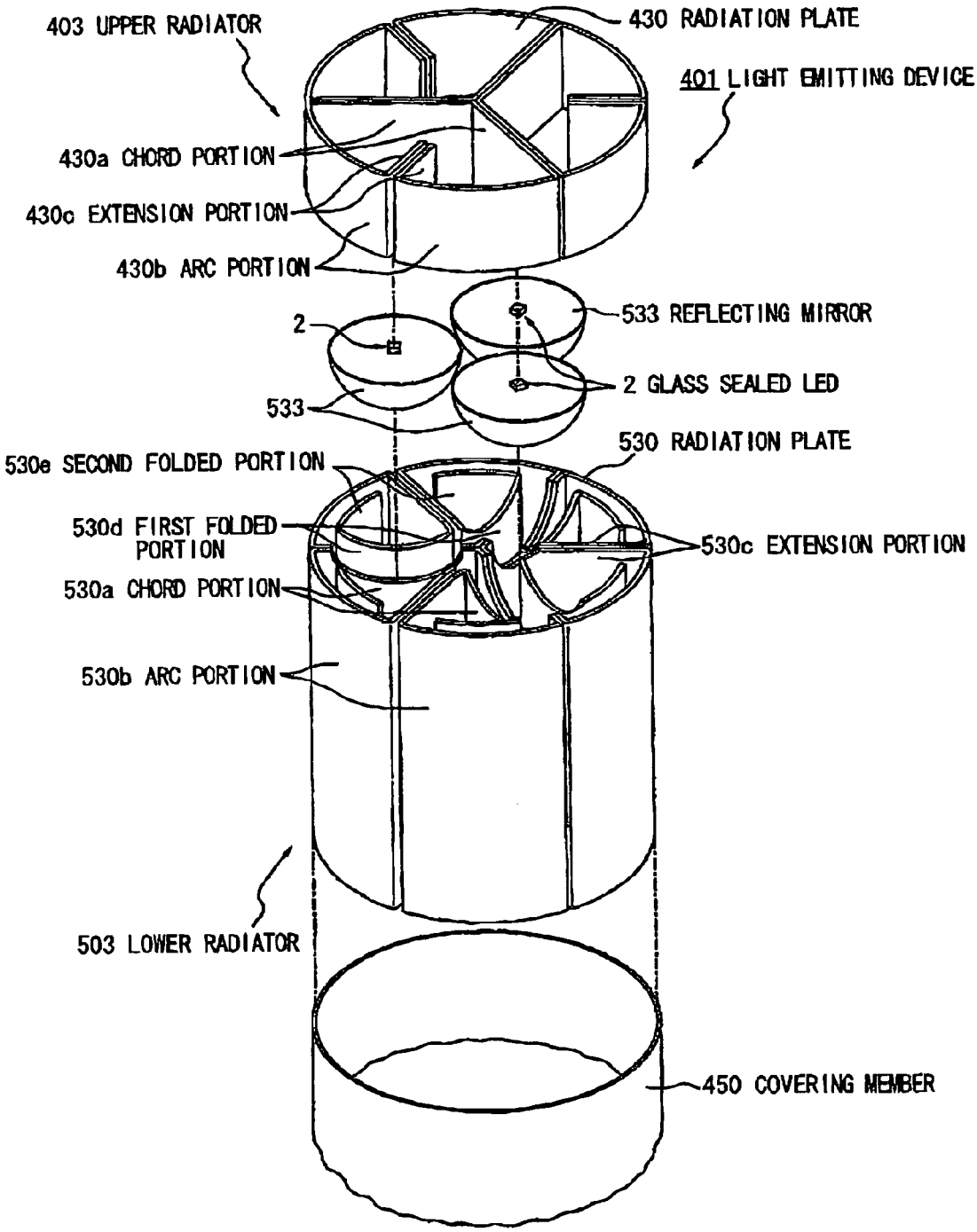
FIG. 29 is a broken perspective view showing a light emitting device in a tenth preferred embodiment according to the invention.
Figure 30:
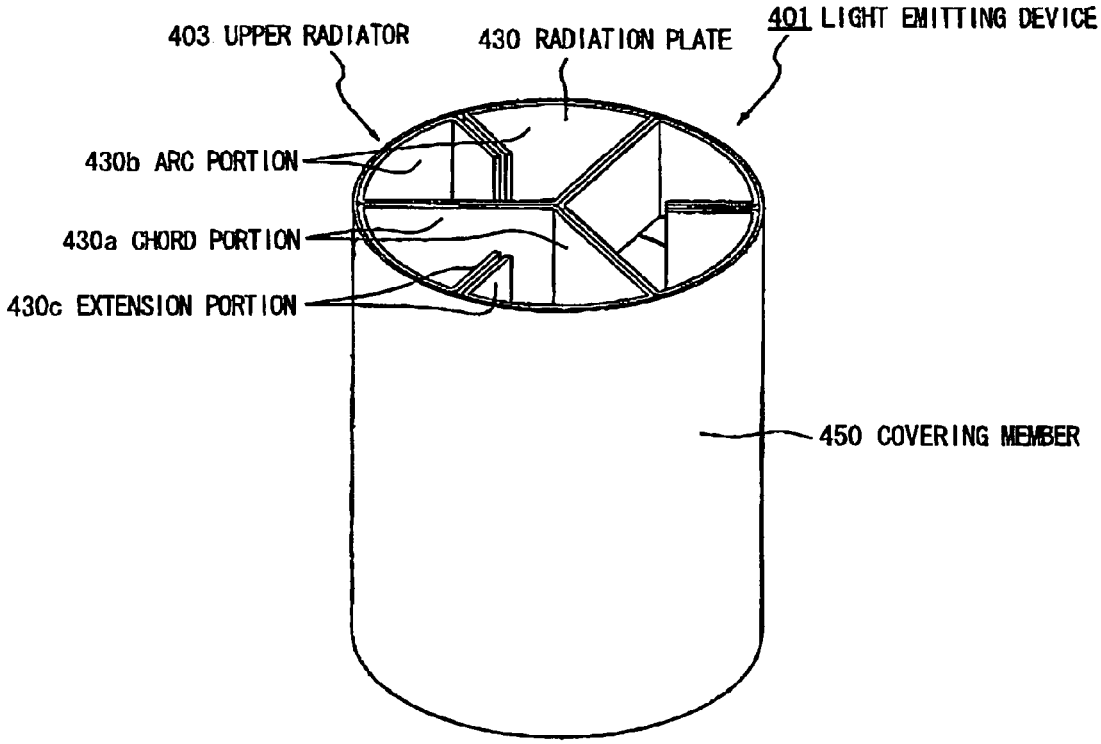
FIG. 30 is a perspective view showing the assembled light emitting device of the tenth preferred embodiment.

FIG. 29 is a broken perspective view showing a light emitting device in the tenth preferred embodiment according to the invention. FIG. 30 is a perspective view showing a light emitting device in the tenth preferred embodiment according to the invention.

As shown in FIG. 29, the light emitting device 401 comprises: a glass sealed LED 2, which is a light source, formed by sealing the LED element 20 with glass; a reflecting mirror 533 to reflect light emitted from the glass sealed LED 2; an upper radiator 403 and a lower radiator 503 that are each formed by integrating (or bonding) plural radiation plates 430, 530 which are formed of a high thermal conductivity material; and a covering member 450 (See FIG. 30) that covers the radiators 403 and 503. The radiators 403, 503 are each composed of the plural thermally conductive plate members 430, 530, respectively, that are bonded to each other to allow at least at a part thereof to be separated from each other. The glass sealed LED 2 is attached to the bottom face of the upper radiator 403, and is electrically connected to a wiring (not shown) formed on the bottom of the upper radiator 403.

The upper radiator 403 and the lower radiator 503 are formed as a whole cylindrical and the lower end of the upper radiator 403 is connected to the upper end of the lower radiator 503. The glass sealed LED 2 and the reflecting mirror 533 are installed in the connection portion between the radiators 403 and 503. The radiators 403, 503 are composed of the plural radiation plates 430, 530, respectively, which are formed of a copper material with a thickness of 1.0 mm. In this embodiment, the radiators 403, 503 are provided with three radiation plates 430, 530, respectively, which are divided and connected in the circumferential direction.

Figure 31A:
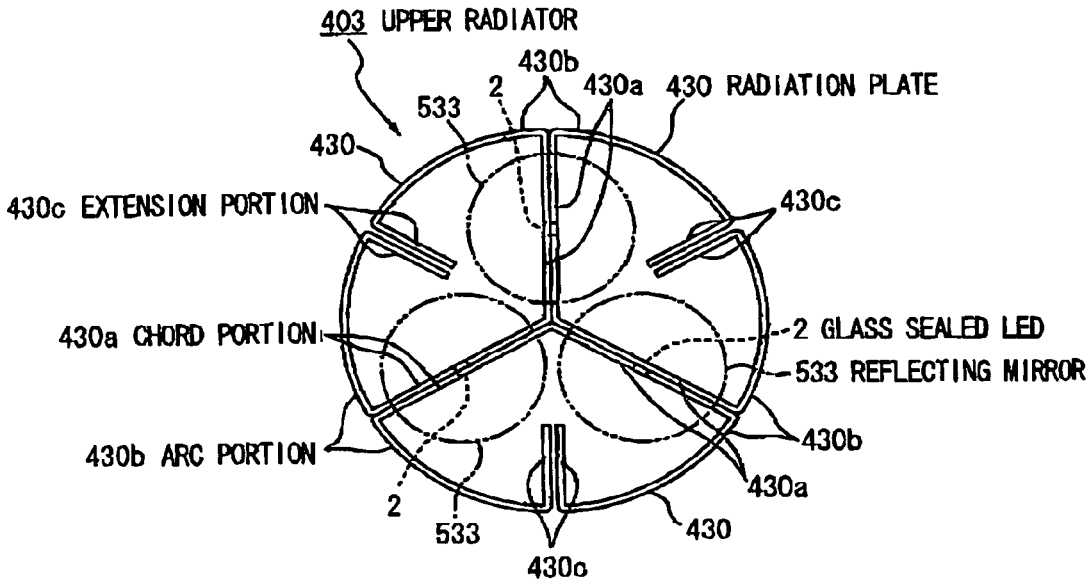
FIG. 31A is a top view showing an upper radiator in FIG. 29.
Figure 31B:
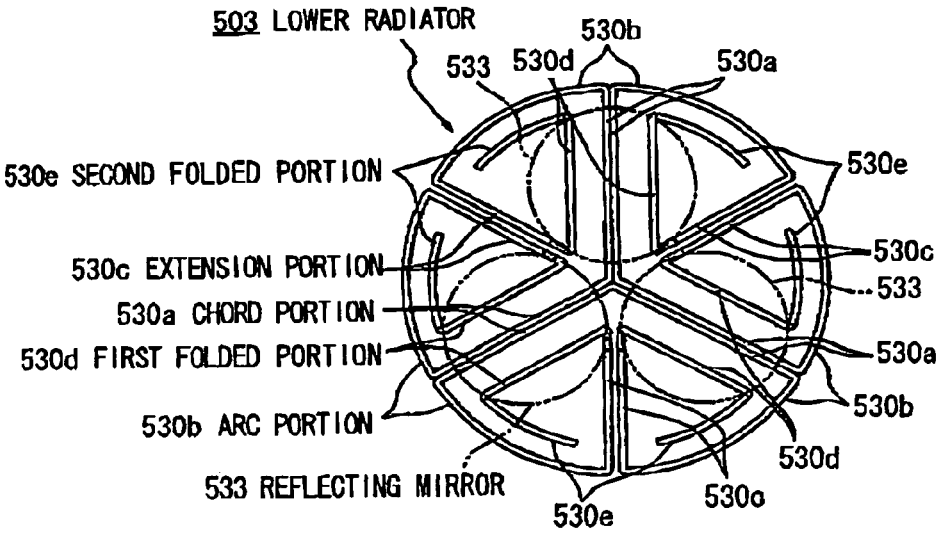
FIG. 31B is a bottom view showing a lower radiator in FIG. 29.

FIG. 31A is a top view showing the upper radiator 403 and FIG. 31B is a bottom view showing the lower radiator 503.

As shown in FIG. 31A, the radiation plates 430 of the upper radiator 403 are vertically extended and formed like a fan in the top view. Each of the radiation plates 430 is composed of a pair of chord portions 530*a* with a center angle of 120° defined therebetween, a pair of arc portions 430*b* extended inward in the circumferential direction from the outer radial ends of the chord portions 430*a* to be close to each other, and extension portions 430*c* extended inward in the radial direction from the end of the arc portions 430*b*. The extension portions 43*c* are disposed facing each other with a predetermined gap. By connecting the chord portions 430*a* of the three radiation plates 430 thus formed, the upper radiator 403 can be formed cylindrical as a whole.

In this embodiment, the glass sealed LED's 2 are disposed under the connection portion of the chord portions 430*a*. Thus, light emitted from the glass sealed LED 2 is radiated downward. The glass sealed LED's 2 are each located at the center of the chord portions in the radial direction.

As shown in FIG. 31B, the radiation plates 530 of the lower radiator 503 are vertically extended and formed like a fan in the top view. Each of the radiation plates 530 is composed of a pair of chord portions 530*a* with a center angle of 120° defined therebetween, a pair of arc portions 530*b* extended inward in the circumferential direction from the outer radial ends of the chord portions 530*a* to be close to each other, and extension portions 530*c* extended inward in the radial direction from the end of the arc portions 530*b*. The extension portions 530*c* are disposed facing each other with a predetermined gap.

Each of the radiation plates 530 comprises a first folded portion 530*d* extended from the radial inner end of the extension portion 530*c* to the same direction as the chord portion 530*a*, and a second folded portion 530*e* extended from the end of the first folded portion 530*d* to the same direction as the arc portion 530*b*. By connecting the chord portions 530*a* of the three radiation plates 530 thus formed, the upper radiator 503 can be formed cylindrical as a whole.

The upper radiator 403 and the lower radiator 503 are connected such that the chord portions 430*a*, 530*a* and the arc portions 430*b*, 530*b*, respectively, correspond with each other when viewed from the top. The reflecting mirror 533 is disposed on the lower radiator 503 such that it corresponds with glass sealed LED 2 attached to the upper radiator 403 when viewed from the top. The reflecting mirror 533 is formed of a resin material with a metal deposited on its surface or a metal plate, and is formed semispherical to cover the downside of the glass sealed LED 2. The chord portion 530*a* and the first folded portion 530*d* of the radiation plates 530 are, at its top end, with a notch 530*f* to receive the reflecting mirror 533. In the light emitting device 401, light emitted from the glass sealed LED 2 is reflected upward on the reflecting mirror 533, and the reflected light is extracted while being focused in the top opening of the upper radiator 403.

The covering member 450 is formed of a material with a thermal conductivity lower than that of the radiators 403, 503, and is formed cylindrical. In this embodiment, the radiators 403, 503 are externally secured and integrated by the covering member 450. The covering member 450 is formed of a metal, e.g., stainless steel, easy to process by laser welding.

Advantages of the Tenth Embodiment

The following advantages can be obtained by the tenth embodiment.

(1) Since light emitted from the glass sealed LED 2 is focused by using the reflecting mirror 533, the light emitting device 401 can be used as a spot light source. Although the glass sealed LED 2 and the reflecting mirror 533 need to be disposed inside the radiator system, the light emitting device 401 can be easy assembled since the radiator system is divided into the upper radiator 403 with the glass sealed LED 2 mounted thereon and the lower radiator 503 with the reflecting mirror 533 mounted thereon. Further, since the divided upper radiator 403 and lower radiator 503 are externally secured to each other by the covering member 450, heat generated from the glass sealed LED 2 can be efficiently radiated from the upper radiator 403 to the lower radiator 503.

(2) Since the radiators 403, 503 are covered with the low-thermal conductivity covering member 450, the covering member 450 can be kept at lower temperature than the radiators 403, 503. Therefore, some external parts close to the light emitting device 401 can be prevented from being overheated and it is rendered safe and easy to hold the light emitting device 401.

(3) Since the thin radiation plates 430, 530 formed of a high-thermal conductivity copper material are stacked and integrated to form a thick portion, the radiators 403, 503 can be excellent in productivity. Further, since the number of the radiation plates 430, 530 or radiation shape thereof can be easy changed according to a desired radiation characteristic, the radiators 403, 503 can have a suitable radiation property according to the number or heating value of LED elements 20. Furthermore, since the glass sealed LED 2 as a heat source is mounted on the end face of the radiation plate 430, heat generated from the LED elements 20 can be radiated directly to the radiation plate 430.

(4) Since the radiation plates 430, 530 each have the extension portions 430*c*, 530*c*, respectively, the surface area of the radiators 403, 503 can be increased. Thus, heat can be efficiently radiated through the radiators 403, 503 and the radiators 403, 503 can be downsized and lightened. The lower radiator 503 can have a further increased surface area since it has the folded portions 530*d*, 530*e*.

Figure 32:
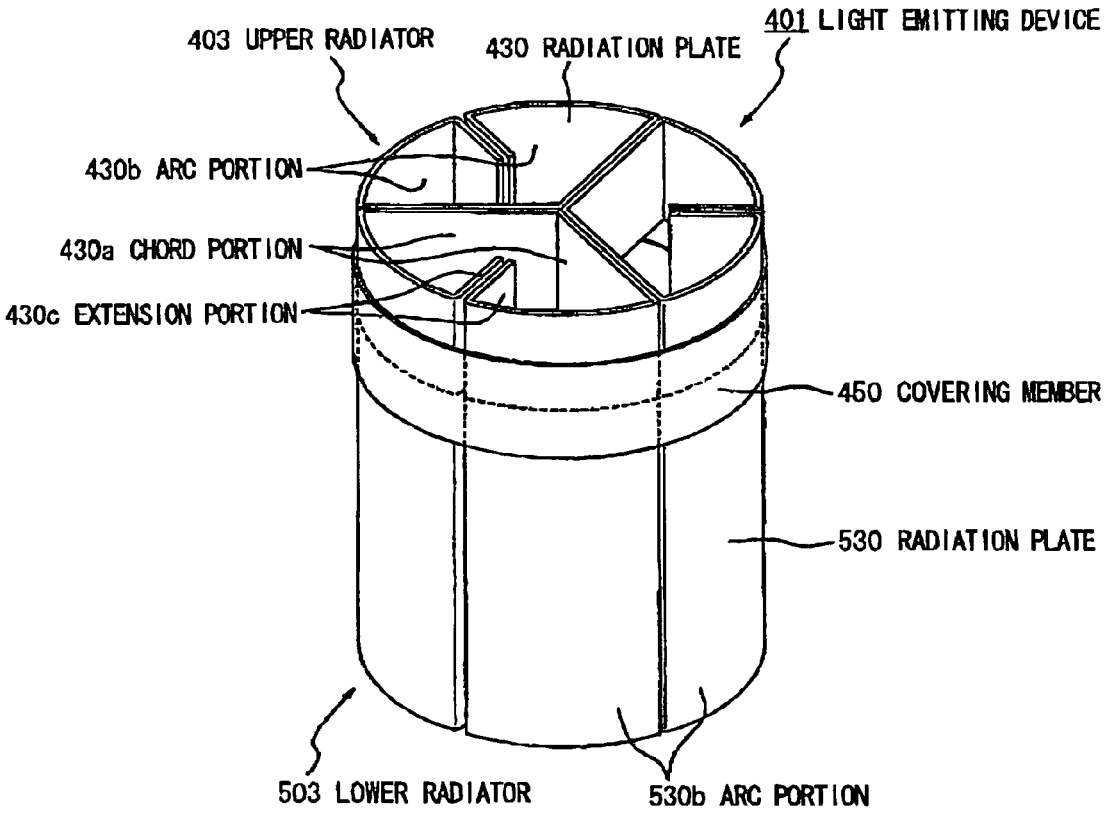
FIG. 32 is a perspective view showing a modification of the tenth preferred embodiment.
Figure 33:
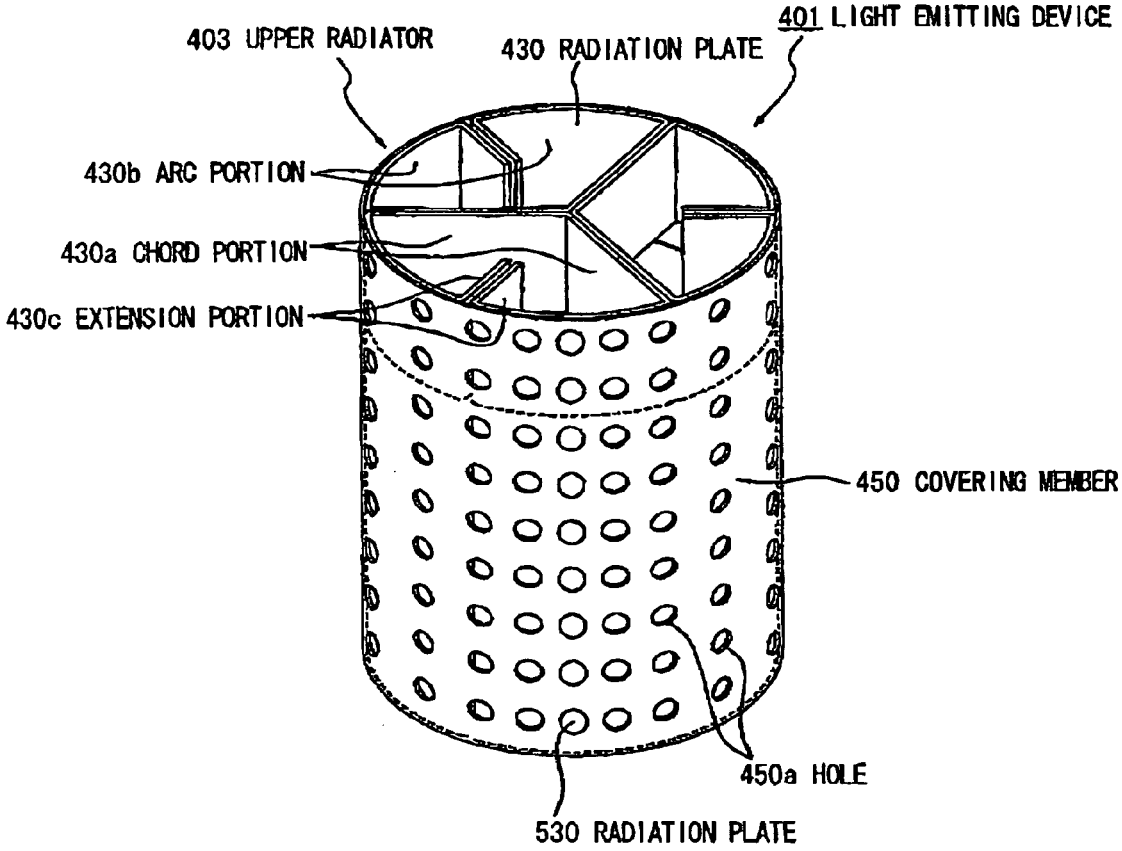
FIG. 33 is a perspective view showing another modification of the tenth preferred embodiment.

Although in the tenth embodiment the outer surface of the radiators 403, 503 is entirely covered by the covering member 450, the outer surface of the radiators 403, 503 may be partially covered by the covering member 450 as shown in FIGS. 32 and 33.

FIG. 32 shows that the connection portion between the radiators 403, 503 and its vicinity are covered by the covering member 450. Thus, the heat radiation performance of the radiators 403, 503 can be increased while keeping the securing function for the radiators 403, 503.

FIG. 33 shows that the covering member 450 entirely covering the radiators 403, 503 is provided with plural holes 450*a*. Thus, the covering member 450 becomes easy to hold and heat from the radiators 403, 503 can be externally radiated though the holes 550*a*. It is very advantageous in practical use.

Although in the tenth embodiment the radiator system is divided into the upper radiator 403 and the lower radiator 53, they may be integrally formed. Optionally, a high-thermal conductivity material may be disposed between the radiators 403, 503 and the covering member 450 to enhance the heat transmission between the radiators 403 and 503. The upper radiator 403 and the lower radiator 503 can be formed in an arbitrary shape, e.g., a rectangular cylinder other than cylindrical as exemplified in the tenth embodiment.

Eleventh Embodiment

Composition of Light Emitting Device

Figure 34:
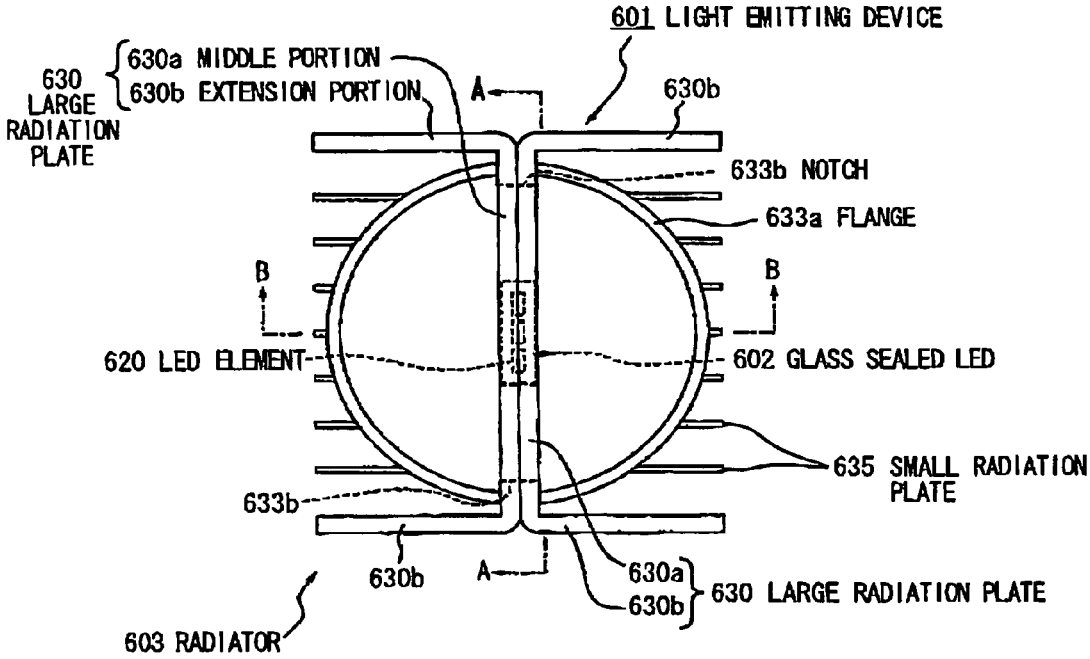
FIG. 34 is a top view showing a light emitting device in an eleventh preferred embodiment according to the invention.
Figure 35:
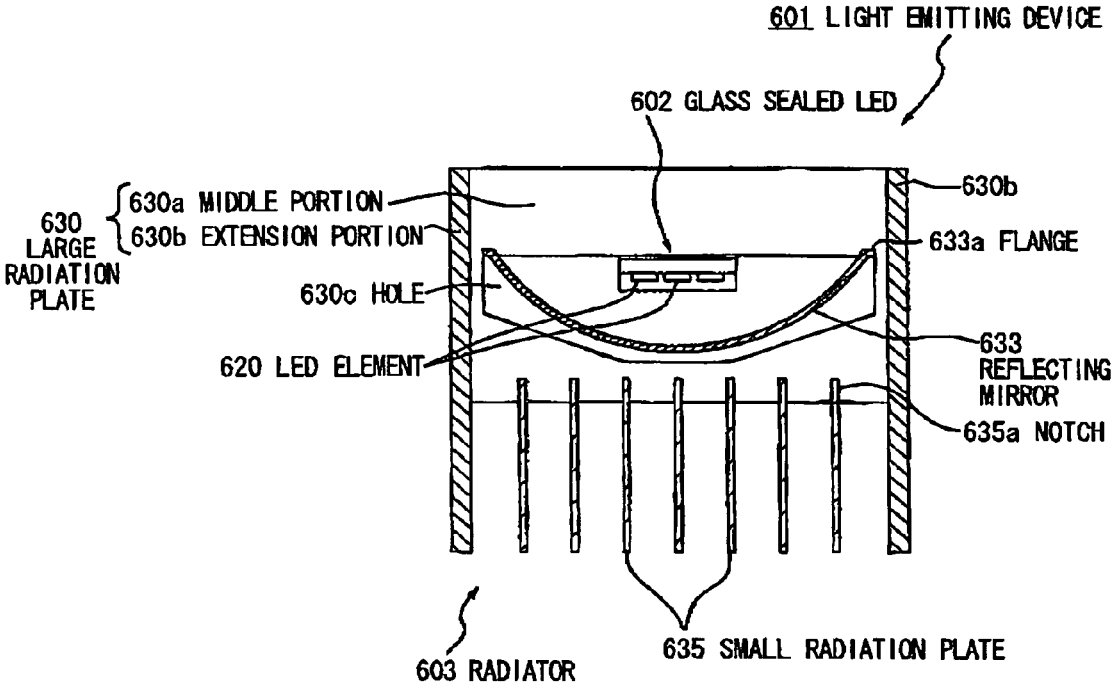
FIG. 35 is a cross sectional view cut along a line A-A in FIG. 34.
Figure 36:
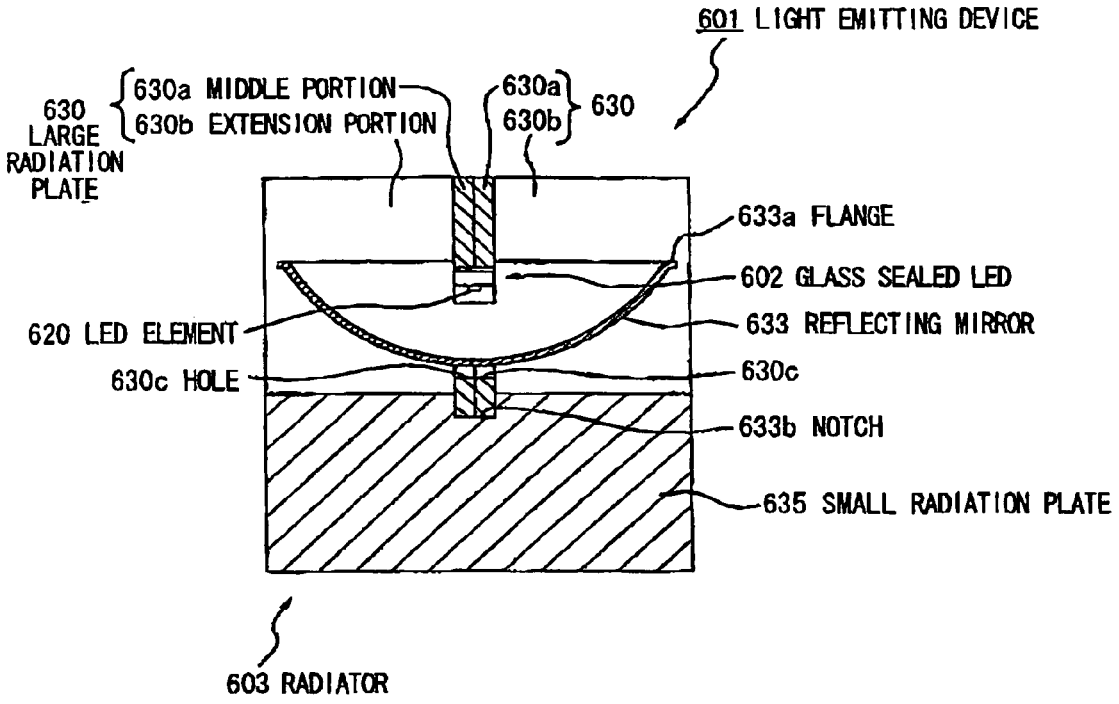
FIG. 36 is a cross sectional view cut along a line B-B in FIG. 34.

FIG. 34 is a top view showing a light emitting device in the eleventh preferred embodiment according to the invention. FIG. 35 is a cross sectional view cut along a line A-A in FIG. 34, and FIG. 36 is a cross sectional view cut along a line B-B in FIG. 34.

As shown in FIG. 34, the light emitting device 601 comprises a glass sealed LED 602, which is a light source, formed by sealing LED elements 620 with glass, and a radiator 603 on which the glass sealed LED 602 is mounted. The radiator 603 comprises plural large radiation plates 630 formed of a high-thermal conductivity material, and plural small radiation plates 635, where the radiation plates 630, 635 are integrally bonded through the Au—Sn joint. Thus, the radiator 603 is composed of the plural radiation plates 630, 635 that are bonded to each other while being partially separated from each other.

In this embodiment, the LED element 620 is 220 μm×480 μm and formed elongate when viewed from the top. The glass sealed LED 602 is composed of the three LED elements 620 arrayed in the longitudinal direction. The glass sealed LED 602 is 1.0 mm×3.2 mm when viewed from the top, the Al2O3 substrate is 0.25 mm in thickness and the glass sealing material is 0.8 mm in thickness.

The radiator 603 comprises two large radiation plates 630 each formed of a 0.5 mm thick copper plate and seven small radiation plates 635 each formed of a 0.1 mm thick copper plate. The large radiation plate 630 comprises a middle portion 630*a* which has a laterally-directed face and on which the glass sealed LED 602 is mounted, and extension portions 630*b* which are extended outside in the lateral direction from the front and back ends of the middle portion 630*a*. As shown in FIG. 35, the lower end of the middle portion 630*a* is located above the lower end of the extension portions 630*b*. The two large radiation plates 630 are in contact with each other at the inner side faces thereof, where they are bonded to each other through the Au—Sn joint.

The middle portion 603*a* of the large radiation plate has a hole (or space) 630*c* in which the glass sealed LED 602 and a reflecting mirror 633 are disposed. The glass sealed LED 602 is attached to the top face of the hole 630*c* and radiates light downward. The reflecting mirror 633 is disposed under the glass sealed LED 602 to reflect the light upward. The reflecting mirror 633 is formed of a resin material with a metal deposited thereon or a metal plate, and it is opened on the top side and shaped like a paraboloid of revolution with the glass sealed LED 602 located at its focal point. The reflecting mirror 633 has a flange 633*a* extended in its periphery. As shown in FIG. 34, the flange 633*a* is provided with a notch 633*b* to receive the large radiation plate 633*a*, where the reflecting mirror 633 is fitted into the large radiation plate 630.

The small radiation plates 635 are arrayed with its faces directed in the vertical direction and connected to the lower end of the middle portion 630*a* of the large radiation plate 630. As shown in FIG. 36, the small radiation plates have at the middle of the top side a notch 635*a* to receive the lower end of the large radiation plate 630. The small radiation plate 635 and the large radiation plate 630 are bonded to each other through the Au—Sn joint.

Advantages of the Eleventh Embodiment

In the eleventh embodiment, since the glass sealed LED 602 is not exposed outside, the appearance can be simple and the glass sealed LED 602 can be effectively protected. By the reflecting mirror 633, light emitted from the glass sealed LED 602 can be externally radiated in a desired distribution. Since the large radiation plate 630 defining the outer periphery is made relatively thick, the strength and durability of the device can be enhanced. Also, since the small radiation plate 635 is made relatively thin, the device can be lightened.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A light emitting device, comprising:

a light source comprising a light emitting diode (LED) element, a substrate comprising a front surface on which the LED element is mounted and a back surface on which a radiation pattern is attached, and a sealing material for sealing the LED element;

a radiator comprising a plurality of plate members comprising a thermally-conductive material; and a wiring substrate for supplying power to the light source, the wiring substrate comprising an opening part through which the light source and the radiator connect, wherein said radiation pattern is disposed within the light emitting device directly below the LED element to attach, and to transfer heat from the light source, to the plurality of plate members, the radiation pattern being electrically isolated from the LED element, wherein the plurality of plate members are laminated on each other at a proximal end and extended outwardly at a distal end to form a space between each other at the distal end, and wherein the light source is mounted on a parallel-laminated area of the plurality of laminated plate members.

2. The light emitting device according to claim 1, wherein said substrate has a same thermal expansion coefficient as the LED element, and wherein said sealing material has a same thermal expansion coefficient as the LED element.

3. The light emitting device according to claim 1, wherein the radiator comprises the laminated plate members integrated by caulking.

4. The light emitting device according to claim 1, wherein the radiator comprises the laminated plate members comprising an edge part formed into a corrugated shape.

5. The light emitting device according to claim 1, wherein the light source comprises a wavelength converter to convert a wavelength emitted from the LED element.

6. The light emitting device according to claim 1, wherein each of the plurality of plate members comprises a different bending angle.

7. The light emitting device according to claim 1, wherein the wiring substrate is disposed around the radiation pattern within the light emitting device to electrically connect the LED to an external power supply, a lower surface of the wiring substrate comprising an insulating layer, and wherein the insulating layer is disposed between the light emitting device and the plurality of plate members to electrically isolate the light emitting device from the plurality of plate members.

8. The light emitting device according to claim 7, wherein the radiation pattern is attached to a central portion of the back surface of the substrate, and wherein the wiring substrate is attached to a peripheral portion of the back surface of the substrate.

9. The light emitting device according to claim 8, wherein the radiation pattern is isolated from the wiring substrate, and wherein the radiation pattern overlaps an entirety of the LED element in an orthogonal direction to an extension direction of the substrate.

10. The light emitting device according to claim 1, wherein said parallel-laminated area is located on a side surface of the plurality of laminated plate members, said side surface covering said proximal end of each of the plurality of laminated plate members.

11. The light emitting device according to claim 1, wherein an insulating layer is attached to the back surface, said insulating layer comprising a through hole that is filled with the radiation pattern, and wherein the insulating layer electrically isolates said through hole from the wiring substrate, said wiring substrate being disposed around the radiation pattern to electrically connect the LED to an external power supply.

12. A light emitting device, comprising:

a light source comprising a light emitting diode (LED) element, a substrate comprising a front surface on which the LED element is mounted and a back surface on which a radiation pattern is attached, and a sealing material for sealing the LED element;

a radiator comprising a plurality of thermally conductive plates; and a wiring substrate for supplying power to the light source, the wiring substrate comprising an opening part through which the light source and the radiator connect, wherein said radiation pattern is disposed within the light emitting device directly below the LED element to attach, and to transfer heat from the light source, to the plurality of thermally conductive plates, the radiation pattern being electrically isolated from the LED element, wherein the plurality of thermally conductive plates are laminated on each other at a proximal end and extended outwardly at a distal end while allowing at least a part thereof to be separated from each other at the distal end, and wherein the light source is mounted on a parallel-laminated area of the radiator.

13. The light emitting device according to claim 12, wherein the radiator has a thermal conductivity of 100 W/m·K or more.

14. The light emitting device according to claim 12, wherein the plurality of thermally conductive plates are directly bonded to the light source.

15. The light emitting device according to claim 12, wherein the plurality of thermally conductive plates are folded at a part thereof.

16. The light emitting device according to claim 12, wherein the LED element and the sealing material have a thermal expansion coefficient of $10\times10^{-6}/°$ C. or less.

17. The light emitting device according to claim 12, wherein the light source further comprises:

a plurality of the LED elements, wherein the radiation pattern that is formed on the back surface of the substrate, the LED elements are mounted on the front surface, and the radiation pattern is bonded to the radiator.

18. The light emitting device according to claim 17, wherein the radiation pattern comprises a thermally conductive metal.

19. The light emitting device according to claim 17, wherein the radiation pattern is mounted on the radiator through a material comprising Au and Sn.

20. The light emitting device according to claim 17, wherein the substrate comprises a thickness that is smaller than an interval at which the plurality of the LED elements are disposed on the substrate.

21. The light emitting device according to claim 12, wherein the light source comprises an area of not more than ten times a total area of a plurality of LED elements when viewed from a main surface thereof.

22. The light emitting device according to claim 12, further comprising an optical system to which a light emitted from the light source is inputted.

23. The light emitting device according to claim 12, wherein each of the plurality of thermally conductive plates comprises a different bending angle.

24. The light emitting device according to claim 12, wherein the wiring substrate is disposed around the radiation pattern within the light emitting device to electrically connect the LED to an external power supply, a lower surface of the wiring substrate comprising an insulating layer, wherein the insulating layer is disposed between the light emitting device and the plurality of thermally conductive plates, to electrically isolate the light emitting device from the plurality of thermally conductive plates, wherein the radiation pattern is attached to a central portion of the back surface of the substrate, wherein the wiring substrate is attached to a peripheral portion of the back surface of the substrate, wherein the radiation pattern is isolated from the wiring substrate, and wherein the radiation pattern overlaps an entirety of the LED element in an orthogonal direction to an extension direction of the substrate.

* * * * *